US008638970B2

(12) United States Patent
Burton

(10) Patent No.: US 8,638,970 B2
(45) Date of Patent: Jan. 28, 2014

(54) IN-EAR ADAPTER FOR EARBUDS

(75) Inventor: John E. Burton, Ludington, MI (US)

(73) Assignee: Burton Technologies, LLC, Ludington, MI (US)

( * ) Notice: Subject to any disclaimer, the term of this patent is extended or adjusted under 35 U.S.C. 154(b) by 919 days.

(21) Appl. No.: 12/178,172

(22) Filed: Jul. 23, 2008

(65) Prior Publication Data

US 2009/0034775 A1 Feb. 5, 2009

Related U.S. Application Data

(60) Provisional application No. 60/962,738, filed on Jul. 31, 2007, provisional application No. 61/019,357, filed on Jan. 7, 2008, provisional application No. 61/028,206, filed on Feb. 13, 2008.

(51) Int. Cl.
*H01R 25/00* (2006.01)

(52) U.S. Cl.
USPC ..... 381/380; 381/382; 181/135

(58) Field of Classification Search
USPC ..... 381/382–383, 380; D14/233
See application file for complete search history.

(56) References Cited

U.S. PATENT DOCUMENTS

| | | | | |
|---|---|---|---|---|
| 2,489,277 | A | 9/1945 | Faralla | |
| 2,487,038 | A * | 11/1949 | Baum | 181/135 |
| 2,508,918 | A * | 5/1950 | Hines, Jr | 455/351 |
| 4,349,083 | A * | 9/1982 | Bennett | 181/135 |
| 4,677,679 | A | 6/1987 | Killion | |
| 4,763,753 | A | 8/1988 | Killion | |
| 4,852,683 | A | 8/1989 | Killion | |
| 5,113,967 | A | 5/1992 | Killion et al. | |
| 5,319,163 | A * | 6/1994 | Scott | 181/130 |
| 5,887,070 | A | 3/1999 | Iseberg et al. | |
| 6,205,227 | B1 | 3/2001 | Mahoney et al. | |
| 6,411,722 | B1 * | 6/2002 | Wolf | 381/371 |
| RE38,351 | E | 12/2003 | Iseberg et al. | |
| 6,666,295 | B2 | 12/2003 | Killion et al. | |
| 6,724,902 | B1 | 4/2004 | Shennib et al. | |

(Continued)

FOREIGN PATENT DOCUMENTS

| | | |
|---|---|---|
| EP | 1496722 A1 | 1/2005 |
| JP | 2002200109 | 7/2002 |
| WO | 9936016 | 7/1999 |

OTHER PUBLICATIONS

English language translation of Japanese Patent 2002-200109.

(Continued)

*Primary Examiner* — Allen Parker
(74) *Attorney, Agent, or Firm* — Warner Norcross & Judd LLP

(57) ABSTRACT

An adapter for attaching to an earphone includes a sleeve capable attaching the adapter to the earphone and an ear portion including a tubular sidewall having a first end attached to the sleeve and a second end opposite the first end. In one embodiment, the tubular sidewall includes an outer surface and a plurality of fins extending outwardly from the outer surface. In another embodiment, the tubular sidewall has an inner surface defining an air channel extending through the sidewall, and the inner surface has a twin cone shape including a converging cone portion extending from the first end and a diverging cone portion extending from the converging cone portion to the second end. In one embodiment, the adapter includes both a plurality of fins, and a twin cone air channel.

17 Claims, 30 Drawing Sheets

(56) References Cited

U.S. PATENT DOCUMENTS

| | | | | |
|---|---|---|---|---|
| 6,830,876 | B2 | 12/2004 | Killion et al. | |
| 2003/0059071 | A1 | 3/2003 | Dunham | |
| 2003/0081794 | A1 | 5/2003 | Fushimi et al. | |
| 2005/0141743 | A1* | 6/2005 | Seto | 381/371 |
| 2005/0147269 | A1* | 7/2005 | Oliveira et al. | 381/382 |
| 2007/0071265 | A1 | 3/2007 | Leedom et al. | |
| 2007/0189569 | A1 | 8/2007 | Haapapuro et al. | |
| 2007/0240931 | A1 | 10/2007 | Killion | |
| 2008/0187159 | A1 | 8/2008 | Blanchard | |

OTHER PUBLICATIONS

Notification of Transmittal of the International Search Report and the Written Opinion of the International Searching Authority, or the Declaration; International Search Report; Written Opinion of the International Searching Authority, International App. No. PCT/US2008/071095, mailed Dec. 16, 2008.

Earbud Buddies Flexible Vinyl Tips for Standard Earbuds, available at http://earplugstore.stores.yahoo.net/earbusirutifo1.html, published at least as early as 12/0/2007.

iBuds, AccessoryGeeks.com, published at least as early as Mar. 22, 2005.

The Whoomp! Earbud Enhancers Review: Apple's Dirty Little Secret, posted Apr. 18, 2008.

Griffin EarJams, iLounge, Jeremy Horwitz, published Sep. 14, 2004.

TuneBuds, Belkin, posted to website May 24, 2006.

* cited by examiner

IN-EAR ADAPTER FOR EARBUDS

BACKGROUND OF INVENTION

The present invention relates generally to ear phones, also known as "earbuds," for handheld electronic devices, such as portable media players ("PMP's") as well as hearing aids, cellular telephones, and other devices adapted for hearing. More particularly, the invention relates to an ear phone adapter that provides enhanced sound isolation, improves retention of the ear phone inside the ear even under extreme activity and perspiration and minimizes acoustical impedance within the ear canal area.

PMP's are popular to use for listening to music while walking or running outdoors or inside on a treadmill, for example. They are commonly used with earbuds, which are miniature speakers that fit into the ears at the entry of the ear canal. Earbuds are comfortable and well suited for this use since they are pocket sized, lightweight and independent pieces that are not as cumbersome to wear or carry as headphones, which have a connecting framework. However, there are a number of drawbacks associated with earbuds. First, they are often ineffective at blocking out ambient noise and preventing leakage of the amplified sound into the surrounding area. Second, the position of the earbud in the ear is often not well controlled or aimed. The result is an erratically shaped passageway for the sound wave to travel as it leaves the speaker inside the earbud and makes its way into the ear canal. Abrupt changes in the direction or area of the passageway through which a sound pressure wave travels will alter both the pressure levels and the molecule motion within the pressure wave and distort the sound produced from the speaker. This type of interference of a sound pressure wave is often called "acoustical impedance" and is well known in the design of horns and wind instruments. Like electrical impedance often specified for speakers, acoustic impedance must be minimized for improved sound quality. The phenomenon of acoustical impedance is readily experienced by simply experimenting with different positions of the earbud within the ear. Third, many users find it difficult to keep the earbud retained in the ear. The cord extending from the earbud is easily snagged, and generally swings or bounces with activity. This movement, combined with perspiration in the ear, can often dislodge the earbud from the ear. In some cases, the earbud can become further entangled in exercise equipment or become an annoying distraction when the listener must repeatedly stop his or her activity to re-secure the earbud. Lastly, fitting the earbud to the ear needs to be accomplished without discomfort to the user. Some users feel discomfort due to the earbuds rigid circular shape which can create too much interference and pressure on the ear.

A number of attempts have been made to design earbuds and related accessories that address the basic problems of retention, the improvement of sound isolation and in ear comfort, but these designs are still significantly lacking in performance in one area or another. One attempt is a thin foam rubber cover that surrounds the ear phone speaker area. The cover adds some grip to the area just outside the ear canal. However, this thin foam easily tears, does not provide improved sound isolation, and the increased grip is generally inadequate to retain the ear piece to the ear with increased levels of activity and motion.

Another attempt to improve retention is an ear piece design with a hook feature that encircles the back side of the ear. First, the hook feature adds considerable bulk to the earbud and is less convenient to carry. Also, the external shape and size of the of the ear in relation to the position, size and angle of entry of the ear canal vary greatly from individual to individual. As a result of the misalignment between speaker and ear canal, sound isolation is difficult to achieve and distortion caused by acoustic impedance becomes problematic.

Yet another attempt to improve retention is to provide earbuds with an "in-ear" elastomeric (often rubber) "insert" portion that fits inside at least a portion of the ear canal. This has the added advantage of improving sound isolation (as explained in more detail below). One existing insert shape that fits inside the ear canal includes a tapered cylinder with a smooth rubber outer surface that is attached to the ear piece by sliding the insert over a rigid tubular support that is formed with the ear phone and extends outwardly from the speaker face. The tubular support allows the passage of sound from the speaker through its center, and its outer surface provides a support and attachment portion for the insert. In some cases, the in-ear insert portions are replaceable with small, medium and large sizes as options. Another insert design includes a spherically shaped hollow outer surface attached to the earbud with a hole through the center for the passage of sound. The spherically shaped design includes a mounting portion that fits onto the earbud over the speaker face.

All of the aforementioned in-ear methods still have drawbacks that cause inadequate retention of the ear piece to the ear canal. This is partly due to the fact that the ear canal has an irregular, non-circular cross section and that the axis or "path" of the ear canal is not linear but rather a circuitous path on its way to the ear drum. The cylindrical elastomeric insert designs described do not conform well to the path of the ear canal due to the rigid structure on which they are mounted. These elastomeric inserts conform less to the shape of the path of the ear canal but rather reshape the ear canal's path to become more the shape of the adapter. The result is a less than optimum fit within the ear canal area, uneven pressure exerted on the ear, and potential discomfort. In addition, because the contours of these elastomeric inserts do not match with the path of the ear canal, gaps can exist and the resiliency of the ear canal to return to its normal shape can act to push out and dislodge the earbud, especially with the help of perspiration and motion from exercise activity.

Another drawback of existing in-ear designs is the smooth surface of the elastomeric profile. When perspiration is introduced, the sweat can migrate into the ear canal and reduce friction by effectively becoming a layer of lubricant between the insert and the ear canal. A hydroplaning effect occurs with heavy perspiration, such that the slightest activity and movement can cause the insert and the ear phone to become quickly dislodged.

Another drawback of existing in-ear designs is that the tubular support used for mounting the insert is poorly shaped to minimize acoustical impedance in that the sound pressure wave travels down a passageway that takes an abrupt change in area from the speaker diameter to the tube diameter and then another abrupt change from the tube diameter as it exists into the ear canal.

In addition to retaining the ear phone in the ear, it is also highly desirable to block out noise from the surrounding environment or from the wind for better audio clarity. This is commonly called "sound isolation" and involves significantly reducing or eliminating air gaps that allow the ingress of outside noise into the ear. Sound isolation also helps reduce the stray audio from the ear buds that may be heard by others, and less volume is needed to hear the audio since it is not competing with outside noise. Using less volume has a direct impact on conserving electrical energy which in turn may extend the duration the battery remains sufficiently charged for use. Another benefit of sound isolation is to help prevent feedback between the earphone speaker and a microphone in the case of a hearing aid or cellular phone.

Unfortunately, due to the drawbacks noted above, existing ear phone products do not provide a comfortable product that is sufficiently retained in place on the ear during physical activities with a desired level of sound isolation.

SUMMARY OF THE INVENTION

The present invention provides an earphone/earbud adapter with both improved retention and sound isolation.

In one embodiment, the adapter includes a sleeve capable of fitting around the sidewall of the earbud to retain the adapter on the earbud, and an ear portion including a tubular sidewall having a first end attached to the sleeve and a second end opposite the first end. The tubular sidewall includes an outer surface, and a plurality of fins extending outwardly from the outer surface around the circumference of the tubular sidewall. The outer surface of the ear portion and the fins are flexible to permit the ear portion to deform as it is inserted into the ear canal. The height, thickness, shape and spacing of the ribs may be proportioned to maximize the retention of the adapter in the ear, while maintaining sound isolation.

In another embodiment, the tubular sidewall includes an inner surface defining an air channel, or passageway, extending through the sidewall to permit the passage of air and sound waves directly through the adapter and into the ear canal. The inner surface may be shaped to minimize acoustical impedance as the sound pressure wave travels through this passageway. In one embodiment, the inner surface has a twin cone shape, including a converging cone portion extending from the first end and a diverging cone portion extending from the converging cone portion to the second end, to provide the desired acoustics. The shape of the inner surface may be tuned to provide a particular tonality.

The adapter may be formed integrally from a single piece, such as an elastomer, for ease of manufacture. In one embodiment, the adapter is formed with an angle between the sleeve portion and the ear portion to permit the user to rotate the adapter to various positions with respect to the earbud for enhanced comfort and retention.

The present invention is well suited as an accessory for the popular original equipment earbuds that come standard with the most popular portable music players. The shape of the outer surface of the ear portion and the shape and proportions of the ribs may increase the retention and sound isolation of these standard earbuds. The shape of the inner surface of the ear portion may further enhance the desired acoustics of the earbuds.

The current embodiments of this invention are shown in the following detailed description and drawings. Other variations, such as (but not limited to) the attachment mechanisms of the adapter to the earbuds, variations in size, proportion, and inclusion or exclusion of the specific individual features are anticipated by the inventor and will be recognized from the description of the current embodiments.

DETAILED DESCRIPTION OF THE CURRENT EMBODIMENTS

I. Overview

Figure 1:
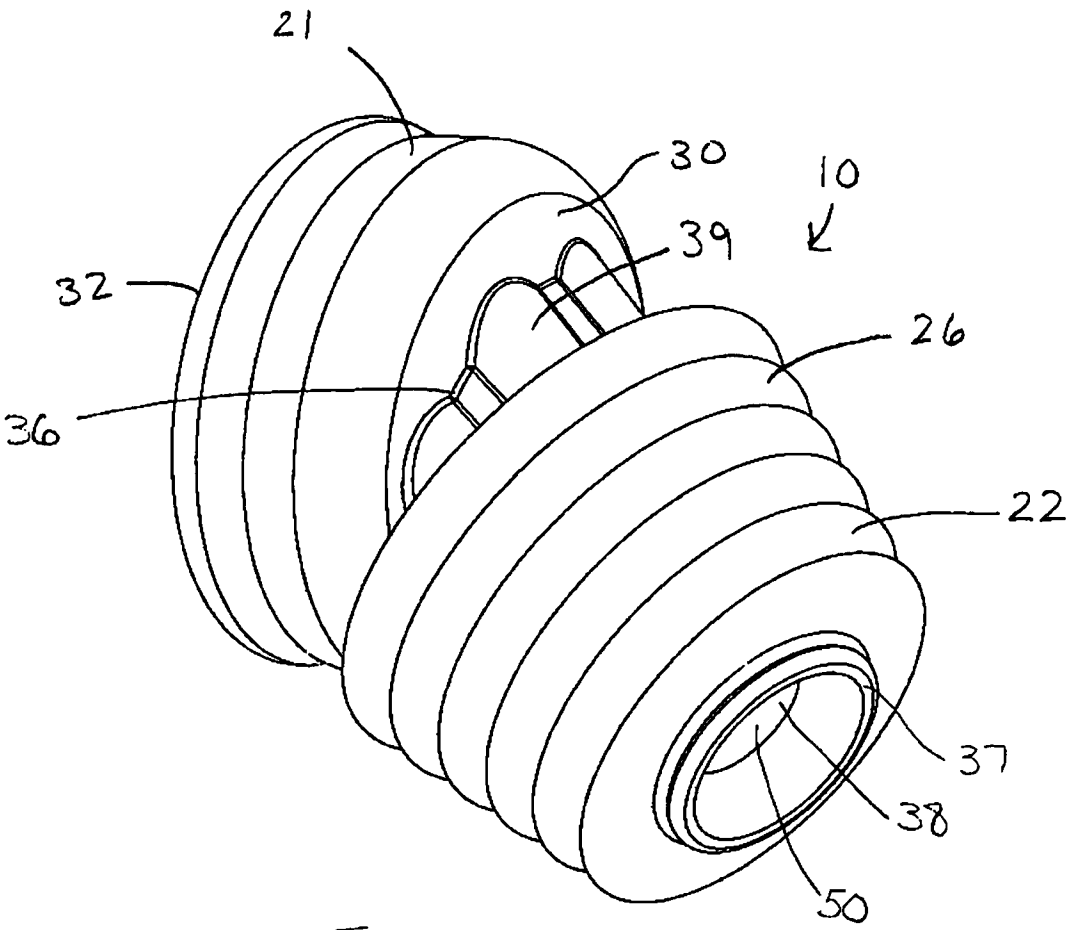
FIG. 1 is a perspective and exploded view of the in-ear adapter according to a first embodiment of the invention.

An in-ear adapter according to a first embodiment of the present invention is shown in FIG. 1 through FIG. 7 and is generally designated 10. As shown, the adapter 10 is designed to mount over an ear phone or "earbud" 20 from an electronic component such as a portable media player, cellular telephone or hearing aid. For purposes of disclosure, the adapter 10 is described in connection with a particular earbud 100, shown in FIG. 8. The earbud 100 has a speaker housing 110 with a sidewall 111 that encapsulates the speaker, and a speaker port 112 mounted to a front edge of the sidewall 111.

The speaker port 112 may include a hole or holes that permit the passage of sound through the speaker port 112.

As illustrated in FIGS. 1-7, the adapter 10 generally includes a sleeve portion 21 that attaches to the outside diameter of the ear phone's sidewall 111, an ear portion 26 extending from the sleeve portion 21, and a plurality of fins 22 extending from the ear portion 26. In one embodiment, the adapter is made integrally, as a single, unitary piece from a soft elastomeric material such as silicone rubber, natural rubber or a thermoplastic elastomer (TPE) or another relatively soft, formable material, with a Shore A durometer of about 20 to 70, and in one embodiment about a 30 Shore A durometer. A variety of alternative materials are acceptable, depending of the desired application. For example, either foamed or solid rubber material would be suitable options. Alternative adapters may be made from two or more materials or pieces that are attached together to form the desired adapter shape.

II. Structure

Figure 4:
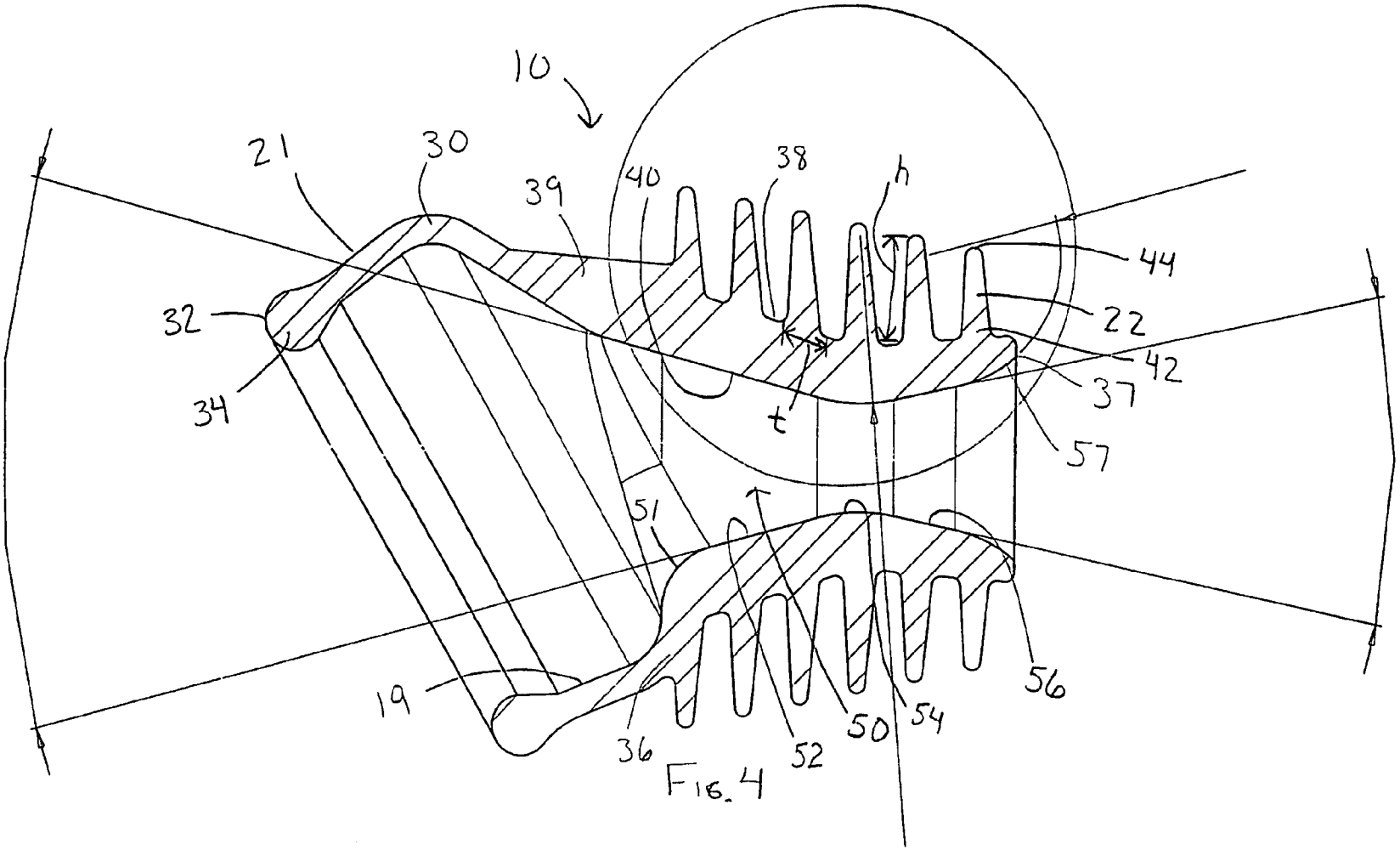
FIG. 4 is a side section view taken along line 4-4 in FIG. 3.
Figure 5:
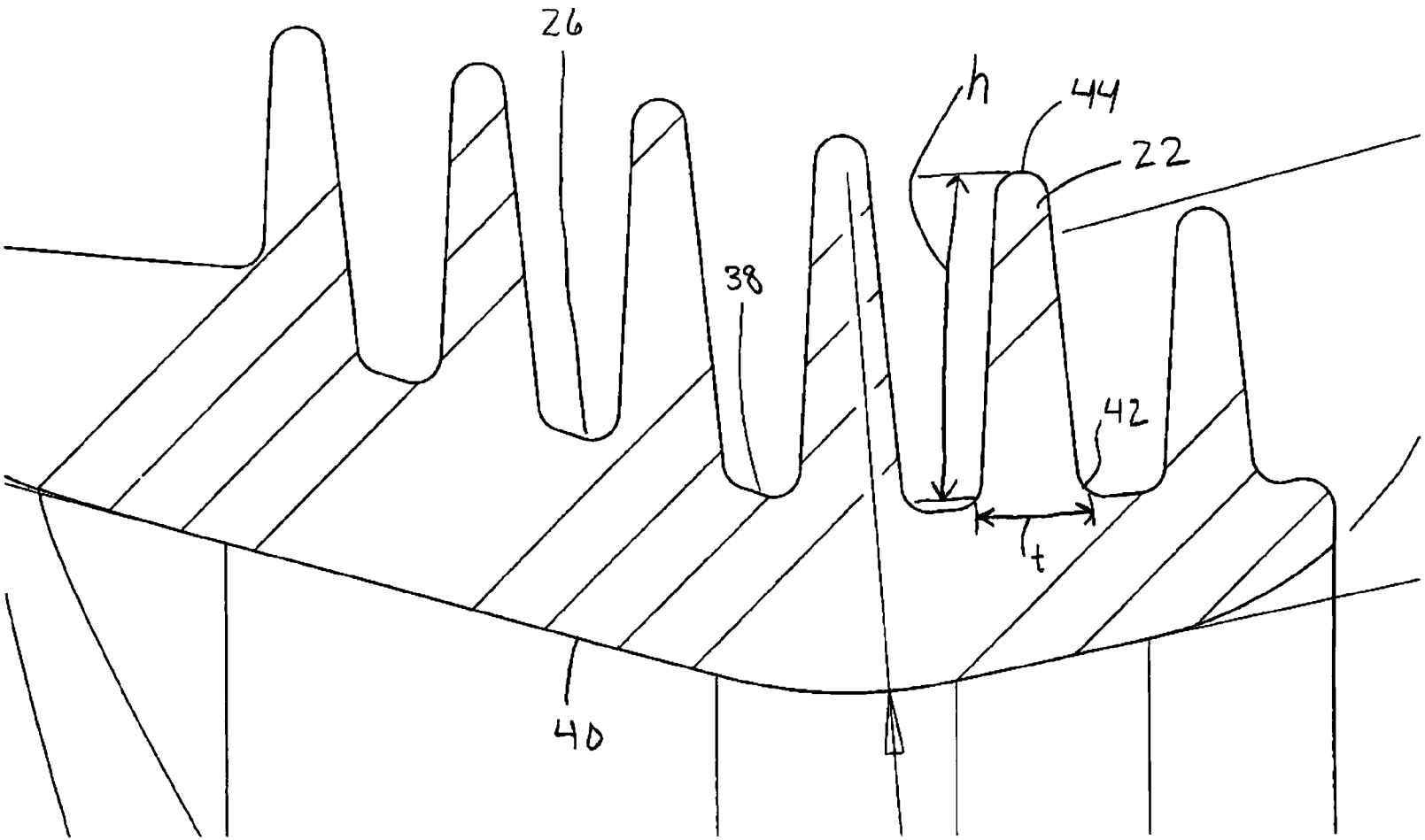
FIG. 5 is close-up view of the portion of the in-ear adapter circled in FIG. 4.
Figure 6:
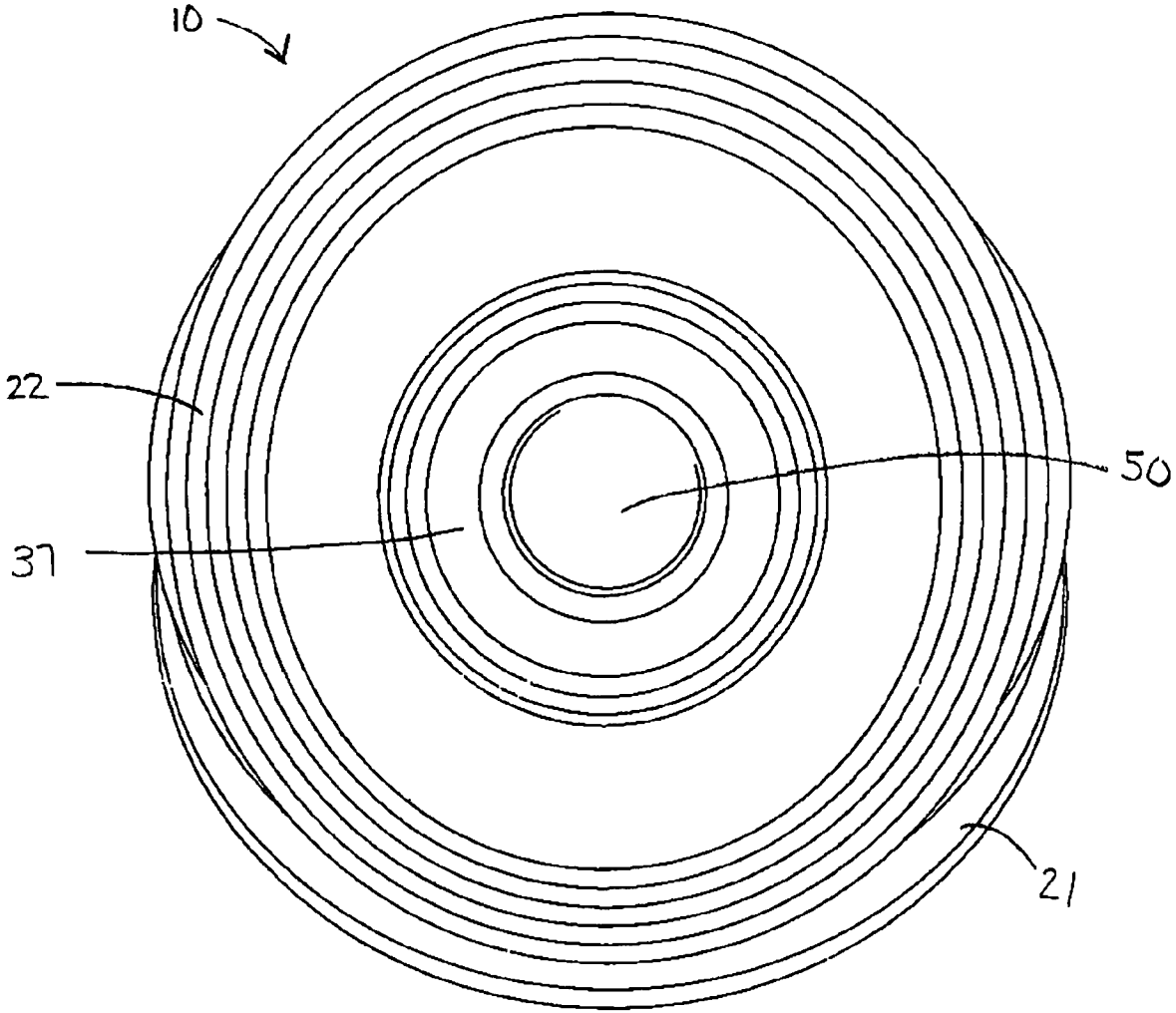
FIG. 6 is a front view of the in-ear adapter according to the first embodiment.
Figure 7:
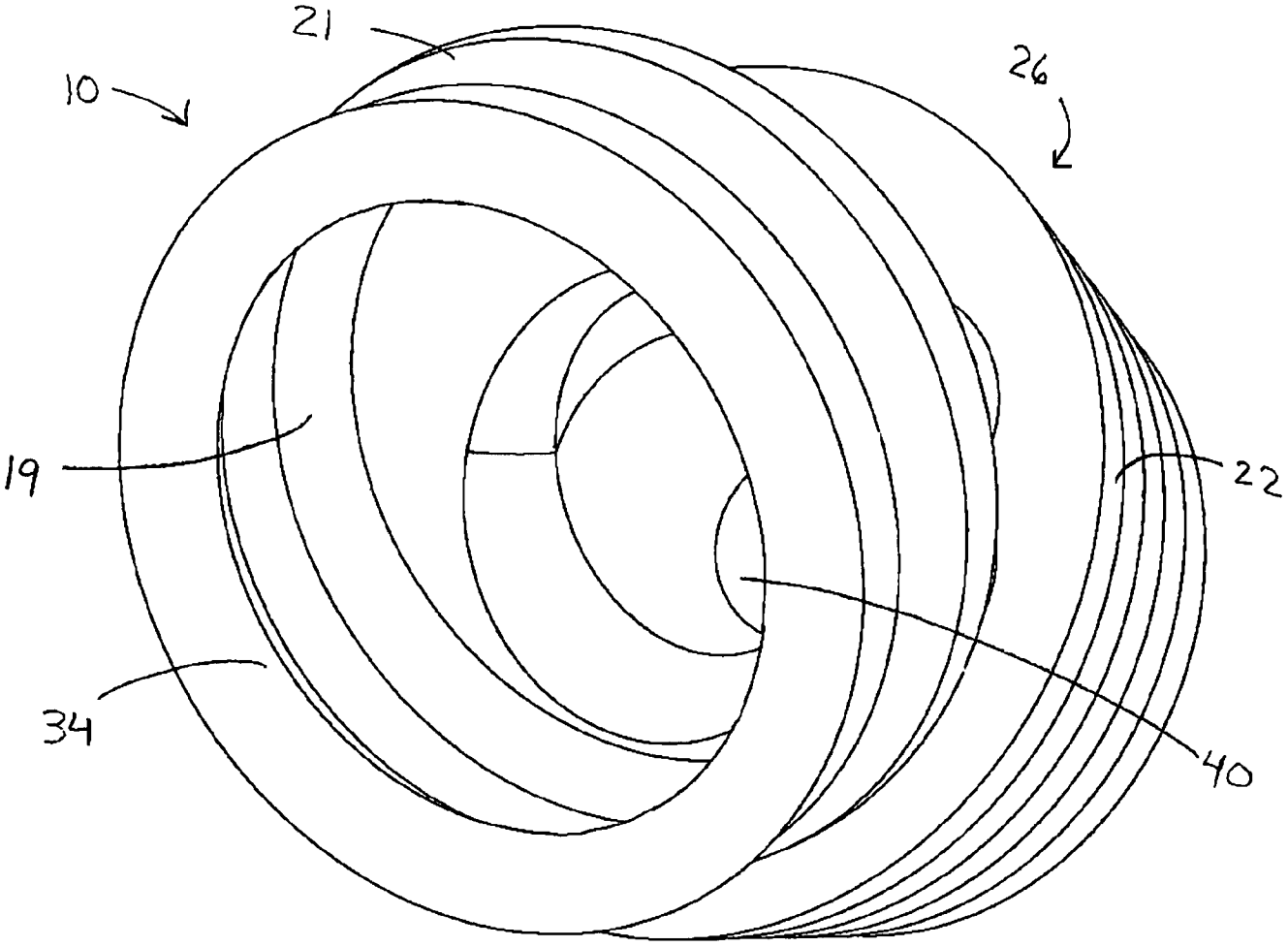
FIG. 7 is a rear perspective view of the in-ear adapter according to the first embodiment.

As shown in FIGS. 1 through 7, in one embodiment, the sleeve portion 21 is a generally annular sleeve that includes an inner surface 19 having a diameter that is sized to fit over the outside of the sidewall 111 of the earbud 100. In one embodiment, the inner surface 19 is sized to press fit over the outside diameter of the earbud 100 for a secure fit. As shown in FIG. 4, in one embodiment, the sleeve portion 21 includes a first end 30 and a second end 32 opposite the first end 30. The sleeve portion 21 may converge from the first end 30 to the second end 32 to allow the sleeve portion 21 to fit firmly over, and partially around, the sidewall 111 of the earbud 100. As illustrated, the inner surface 19 at the first end 30 of the sleeve portion has a diameter of about 13.85 mm, and the inner surface 19 at the second end 32 has a diameter of about 11.50 mm. In addition, the sleeve portion 21 of the illustrated embodiment includes a bulbous edge 34 at the second end 32 to further enhance the tight fit of the sleeve portion 21 on the earbud 100. The bulbous edge 34 reduces the stretch in the second end 32 of the sleeve portion 21 to prevent the sleeve 21 from being pulled off the earbud during activity. The size, shape and configuration of the sleeve portion 21 may vary from application to application in part to accommodate the desired earbuds. In one embodiment, the sleeve portion 21 may be formed with dimensions smaller than those of the ear phone 100 so that the sleeve portion 21 is stretched onto the ear phone 100, which results in the sleeve portion 21 gripping the ear phone 100.

Figure 2:
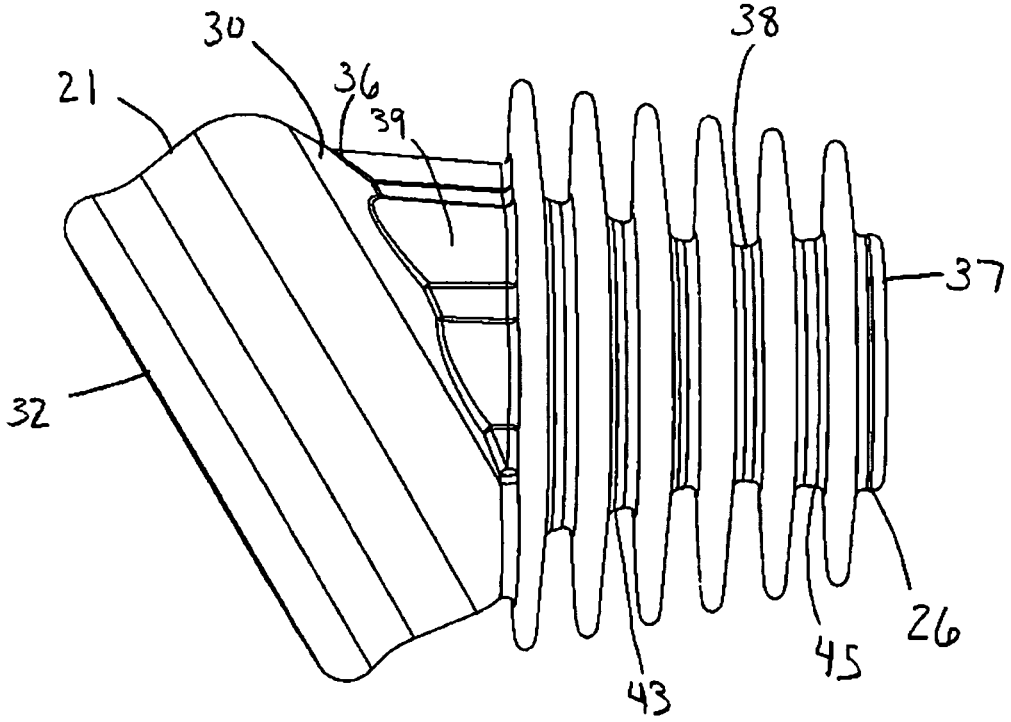
FIG. 2 is a side view of the in-ear adapter according to the first embodiment of the invention.
Figure 3:
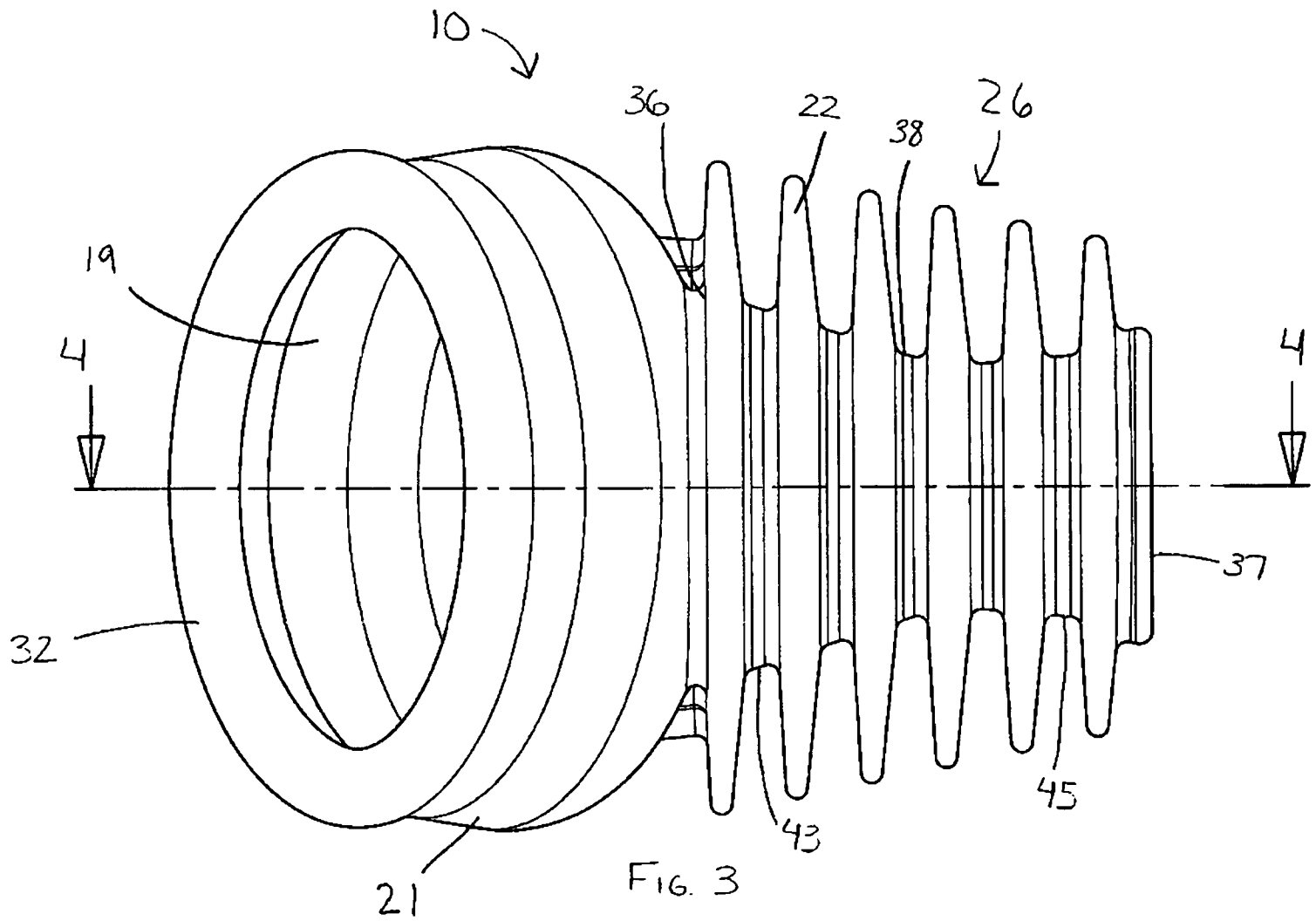
FIG. 3 is bottom view of the in-ear adapter according to the first embodiment of the invention.

Extending away from the sleeve portion 21 is an ear portion 26, which in the illustrated embodiment is a tubular projection having a first end 36 attached to the first end 30 of the sleeve portion 21 and a second end 37 opposite the first end. The ear portion 26 has an outer surface 38 and an inner surface 40 opposite the outer surface 38. The inner surface 40 defines an opening or channel 50 for transmission of sound from the speaker through the adapter 10. The ear portion 26 may be formed integrally with the sleeve portion 21, for instance, by injection molding. The ear portion 26 defines a length between the first and second ends 36, 37, which may vary from application to application and is typically between about 9 mm to 13.5 mm. In one embodiment, the length of the ear portion 26 extends along an axis that is angled from the axis of the sleeve portion 21. As illustrated, the ear portion 26 is angled about 30 degrees from the sleeve portion 21, although the adapter 10 may be constructed with no angle between the sleeve portion 21 and the ear portion 26, or another desired angle. As shown, the angle is created by an extension panel in the ear portion 26, spacing the ear portion 26 from a segment of the sleeve portion 21. The ear portion 26 is formed with a thickness between the inner 40 and outer 38 surfaces that permits the ear portion to flex and deform when inserted into the ear canal. In one embodiment, the thickness of the ear portion 26 is between about 1 mm to 3 mm. In the embodiment shown in FIGS. 1-7, the outer surface 38 of the ear portion 26 is shaped to generally follow the twin cone shape of the inner surface 40, which is described in more detail below. As shown in FIG. 2, a first portion 43 of the outer surface 38 has a converging cone shape and a second portion 45 of the outer surface 38 has a diverging cone shape. As discussed further below in connection with the alternative embodiments, the shape of the outer surface 38 may vary from application to application.

In one embodiment, a plurality of fins 22 extend from the outer surface 38. The fins 22 may be formed integrally with the same material as the ear portion 26, such that they can flex to readily conform to the ear canal. In one embodiment, the fins 22 are approximately evenly spaced apart along the length of the tubular projection 26, between the first and second ends 36, 37, for example, at about 1.75 mm apart. Alternatively, the spacing may vary, including variations in spacing between individual fins 22 along the length of the ear portion 26. In the illustrated embodiment, each fin 22 extends continuously around the circumference of the outer surface 38 of the ear portion 26, although, alternatively, the fins 22 may be intermittent segments, with each segment being spaced from another segment around the circumference of the ear portion 26, and along the length of the ear portion 26. As illustrated, the fins 22 have dimensions that enable them to flex easily for comfort while still providing the desired retention and sound isolation when they are inserted into the ear canal. More flexible fins 22 may provide a more comfortable feel and may facilitate removal of the adapter 10 from the ear canal. Each fin 22 includes a base 42 joined to the outer surface 38 of the ear portion 26, and a tip 44 opposite the base 42. In one embodiment, the fins all have approximately the same height h, from base 42 to tip 44 which is between about 2.75 mm and 3.5 mm tall, although the fin heights may vary from fin to fin. The fins 22 may each have a nearly uniform thickness t, however, in the illustrated embodiment, the thickness tapers from about 0.5 mm at the tip 44 to about 0.75 mm to 1 mm at the base 42. The average thickness of the fins is between about 0.4 and 1.0 mm. Typically, the fin height is at least two times the average fin thickness and the fin thickness is not greater than 1.5 mm at the base, but this is not necessary and the height to thickness ratio may vary from application to application. If desired, different fins 22 may follow different thickness profiles. The fins 22 illustrated in FIGS. 1-7 are shown with optional radii at the tip 44 and base 42. Although shown as having a full radius tip 44, the shape of the tips 44 of the fins 22 may vary from application to application, as desired.

In one embodiment, the fins 22 are generally linear between the base 42 and tip 44. In the embodiment of FIGS. 1-7, they extend outwardly from the outer surface 38 of the ear portion 26 at a slight angle of about 6 degrees towards the sleeve portion 21, however, they may be perpendicular to the outer surface 38, or may extend at a different angle. In the illustrated embodiment, the height h of each fin 22 is approximately at least one-half the size of the diameter of the outer surface 38 of the ear portion 26 to provide a desired amount of flexibility to the fins 22 while maintaining the desired retention and sound isolation qualities. Of course, the spacing, height and thickness of the fins 22 may vary from application to application. As perhaps best shown in FIG. 6, the fins 22 may be oval in shape when viewed from the front to more closely match the shape entry to the ear canal. In the illustrated embodiment, the fins 22 are slightly oval, with a width that is approximately 90% of the height. These proportions may vary from application to application as desired. For example, in some applications, the fins 22 may be essentially circular. Finally, the illustrated embodiment shows a design with six fins 22 spaced apart along the length of the ear portion 26, with the first fin 22 spaced slightly from the second end 37 of the ear portion 26, however, other numbers of fins 22 may be used.

As further shown in FIG. 4, the interior surface 40 of the ear portion 26 may have a shape that is designed to tune the adapter 10 for improved acoustics. As shown in FIG. 4, in one embodiment, the inner surface 38 of the tubular projection defines a twin cone air channel 50. The air channel 50 generally includes a lead-in portion 51, a converging cone 52, a transition portion 54 and a diverging cone 56. The lead-in portion 51 provides a smooth curved transition from the speaker to the converging cone 52. In the illustrated embodiment, the converging cone 52 is shaped to provide a relatively smooth transition from the full diameter of the ear phone to the reduced diameter of the transition portion 54. The converging cone 52 converges the sound wave coming from the speaker down to the transition portion 54. As illustrated, the transition portion 54 relatively smoothly joins the converging cone 52 to the diverging cone 56. The diverging cone 56 functions to diverge and amplify the sound wave from the reduced diameter of the transition portion 54 into the ear canal. The diverging cone 56, with flared end 57 provides a relatively smooth transition from the transition portion 54 to the point where the sound exits the adapter 10 and passes into the air cavity in the ear canal. Although the cone angles and the shapes of the curved transitions may vary from application, the cone angles will typically range between 5 and 25 degrees per side. In the illustrated embodiment, the converging cone 52 has an angle of approximately 15 degrees and the diverging cone 54 has an angle of about 12 degrees. Generally speaking, it has been found that small cone angles may better reproduce lower frequencies and higher cone angles may better reproduce mid and upper range frequencies. Longer diverging cones also may yield more amplification. It may be desirable to adjust the rate at which the cones increase and decrease in angle to provide a pleasing balance of bass, mid and upper frequencies given the speaker driver being used. Using a continuous curved or elliptical profile in both the converging and diverging cones may also be desirable to achieve a desired tonality. This approach would eliminate the fixed angles shown for the converging and diverging cones but does not depart for the intent of the invention.

The illustrated twin cone air channel 50 provides improved sound quality at least in part because the smooth curves in the interior surface 40 of the ear portion reduce or eliminate abrupt changes in the cross-sectional area of the air channel 50. Abrupt changes in the cross-sectional area of the air channel may cause significant changes in both sound wave pressure and air particle velocity. These disruptions may cause undesirable acoustical distortions and reflections. The illustrated twin cone design reduces or eliminates these distortions and reflections, thereby providing improved acoustical performance—perhaps most notably with higher frequency sounds, such as cymbals and snare drums, which are given more clarity and presence. To assist in understanding the advantages of the twin cone design shown in FIG. 4, it may be helpful to view the entire sound pathway between the ear phone speaker and the ear drum as a single tubular passageway. Speakers come in many sizes. To have good sounding bass frequencies, it is desirable to use a speaker with sufficient surface area to push a significant volume of air. Speaker drivers in the 10 mm to 15 mm range may be better at producing bass than smaller drivers. Regardless of the speaker size selected, the converging cone 52 functions in part to gradually converge and reduce the sound waves in area from the speaker diameter as the sound travels through the tubular projection 26 down the ear canal. At the end of the converging cone 52 is the transition portion 54, which provides a gradual transition into the diverging cone 56. The diverging cone 56 gradually increases in area to smooth out the transition as the sound wave enters the air cavity inside the ear canal on its way to the ear drum. The diverging cone 56 does this while also providing a slight amplification of the sound wave. With the twin cone system, area changes are more gradual along the entire pathway from the speaker to the ear drum while more directly aiming the sound down the ear canal. Generally speaking, the objective with the illustrated twin cone air channel is to gradually taper the area of the channel to a point or region then gradually increase the area. Although the illustrated cones have essentially straight walls that taper at a generally constant angle, the cones could have essentially any number of funnel like or curved shapes.

Although the illustrated air channel 50 provides improved sound quality with typical ear phones, the size, shape and configuration of the air channel 50 may vary from application to application. In an alternative embodiment, shown FIG. 16, the inner surface 140 of the air channel 50' tapers as it extends away from the sleeve portion 121, forming a generally frustoconical shaped cavity within the tubular projection 126. Similar to the twin cone design, the cone shaped cavity funnels the sound from the ear phone toward the ear canal, similar to the function of the conventional ear trumpet, and amplifies the sound that is actually heard by the wearer. The exact shape of the cone may be varied to tune the adapter for improved acoustics.

Figure 13:
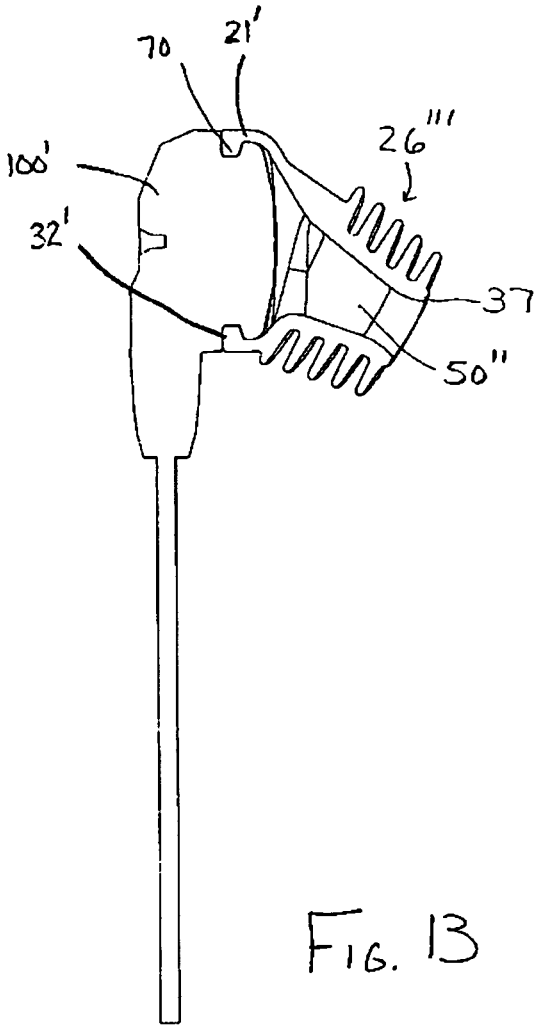
FIG. 13 is a cross sectional view of FIG. 12.
Figure 22:
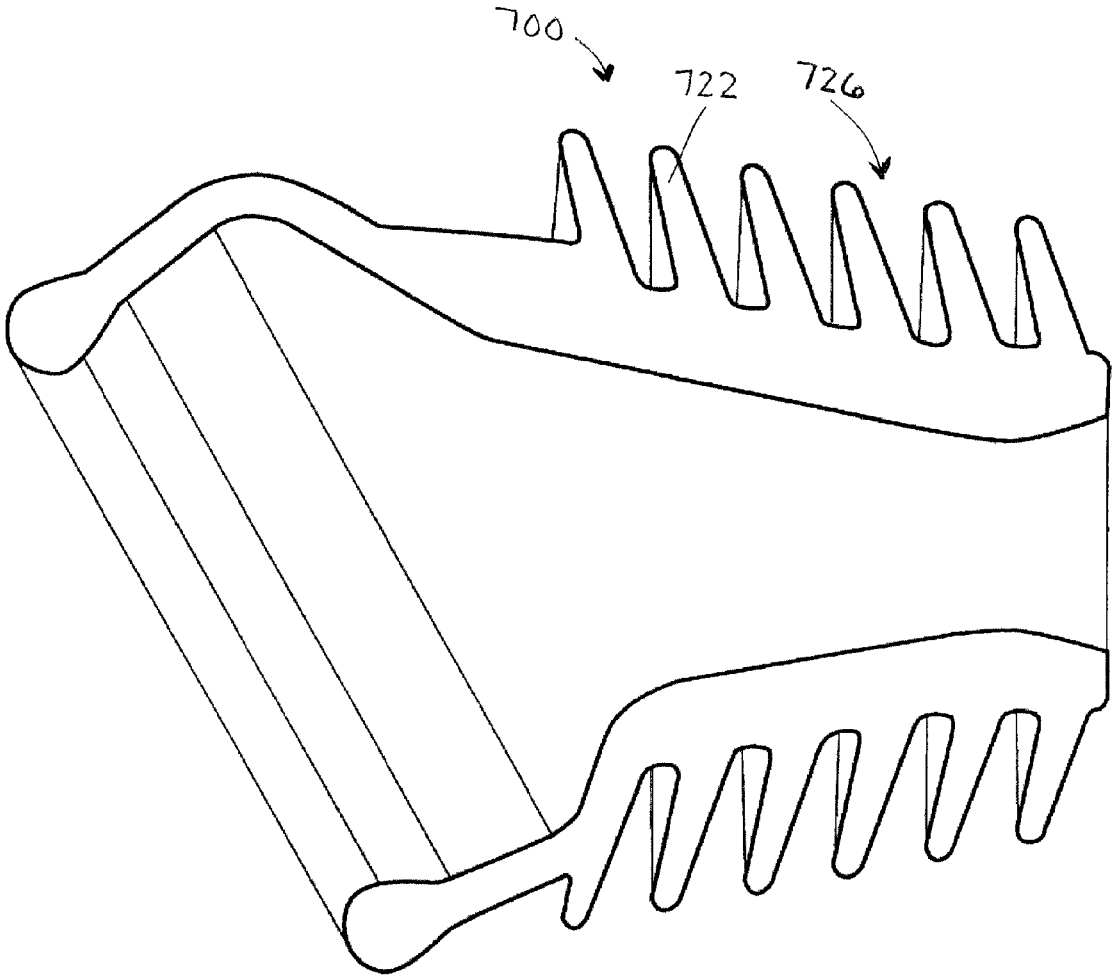
FIG. 22 is a side cross-sectional view of an in-ear adapter according to another embodiment of the present invention.

In one embodiment, such as that shown in FIGS. 13 and 22, the air channel 50" may flare outwardly or may be angled near the port opening at the end of the tubular projection 26 opposite the sleeve portion 21 in order to provide some of the effects of the diverging cone discussed above.

III. Alternative Embodiments

Figure 8:
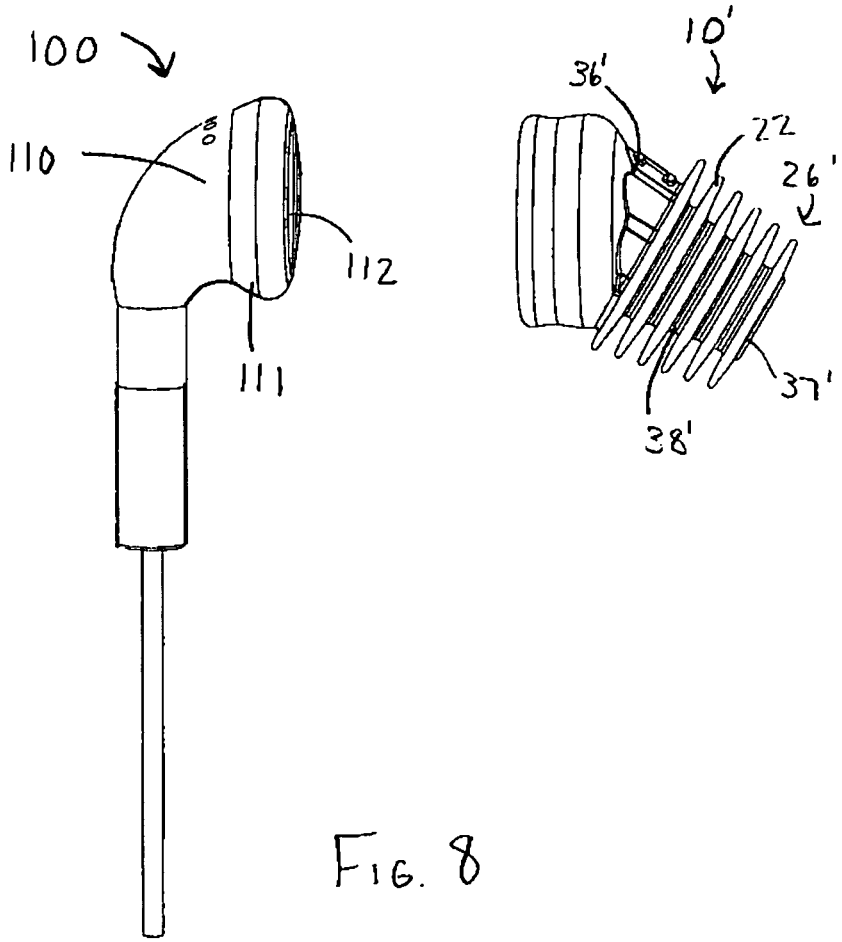
FIG. 8 is a side exploded view of an earbud and the in-ear adapter according to an alternative embodiment of the invention.
Figure 9:
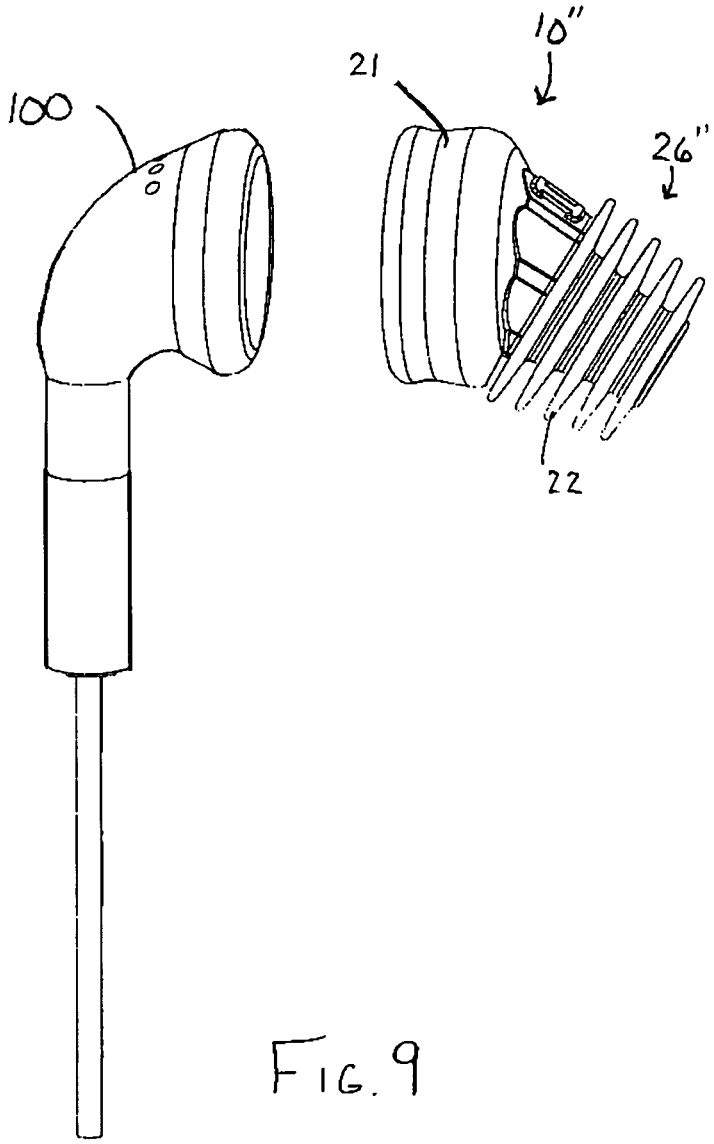
FIG. 9 is a side exploded view of an earbud and the in-ear adapter according to another alternative embodiment of the invention.
Figure 10:
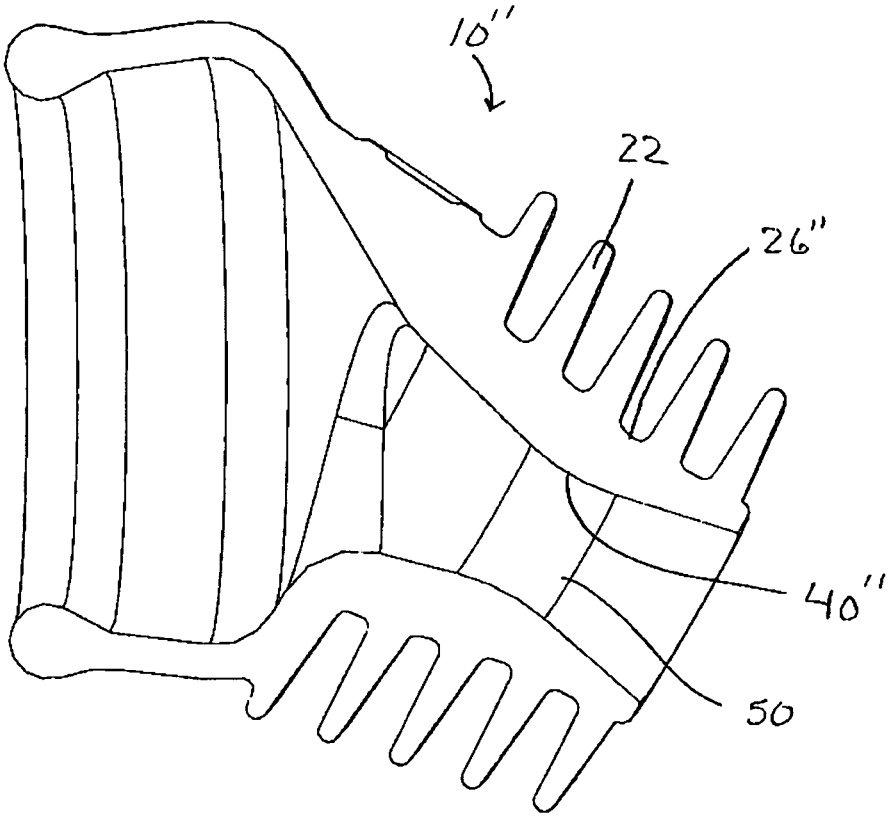
FIG. 10 is a side cross sectional view of the in-ear adapter of FIG. 9.

FIGS. 8-31 show various variations and alternative embodiments of the adapter 10 described above. The adapter 10' shown in FIG. 8 is substantially similar to the adapter 10 shown in FIGS. 1-7, except that the outer surface 38' of the ear portion 26' is cone shaped, such that the outer surface 38' continuously converges from the first end 36' to the second end 37'. The adapter 10" shown in FIG. 9 is substantially similar to the adapter of FIG. 8, except that the length of the ear portion 26" of adapter 10" is shorter, and the ear portion 26" includes only five fins 22 instead of six. Additional variations of the length of the ear portion and the number of fins are possible, depending on the desired retention characteristics, or for the manufacture of adapters of different sizes to accommodate different size ears. FIG. 10 shows a cross section of the five fin adapter, wherein the inner surface 40" includes a twin cone air channel 50.

Figure 11:
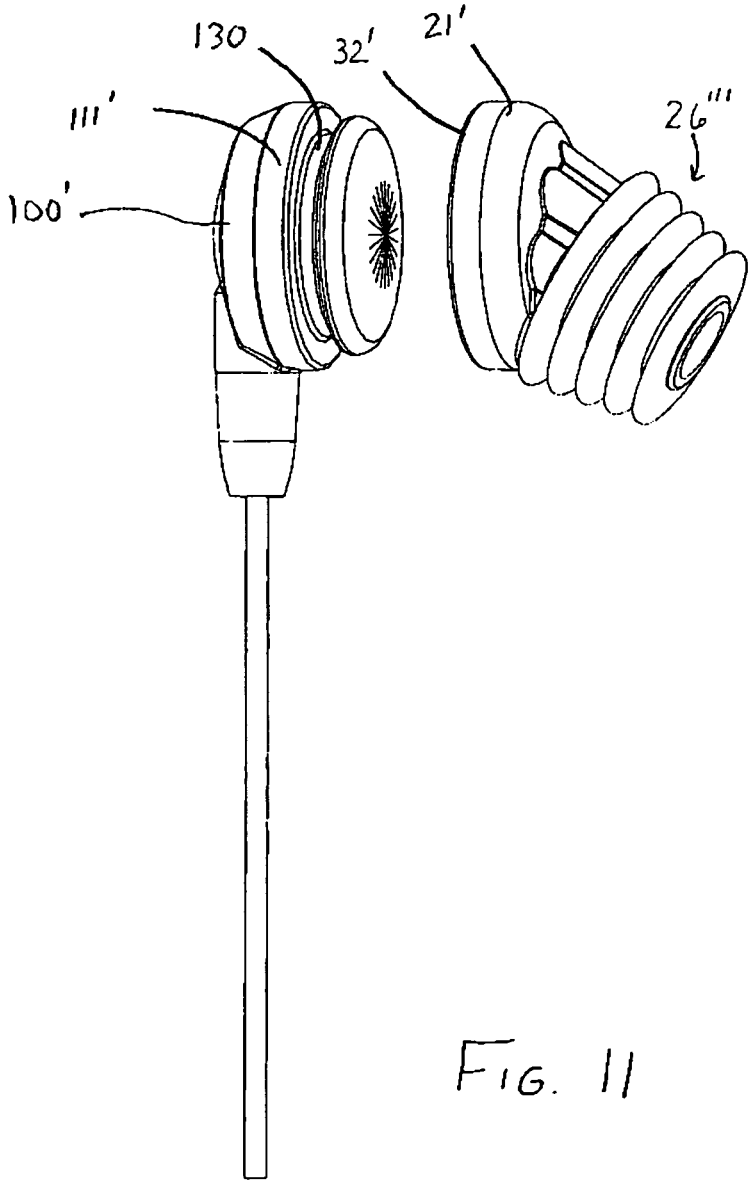
FIG. 11 is an exploded perspective view of an earbud and the in-ear adapter according to another alternative embodiment of the invention.
Figure 12:
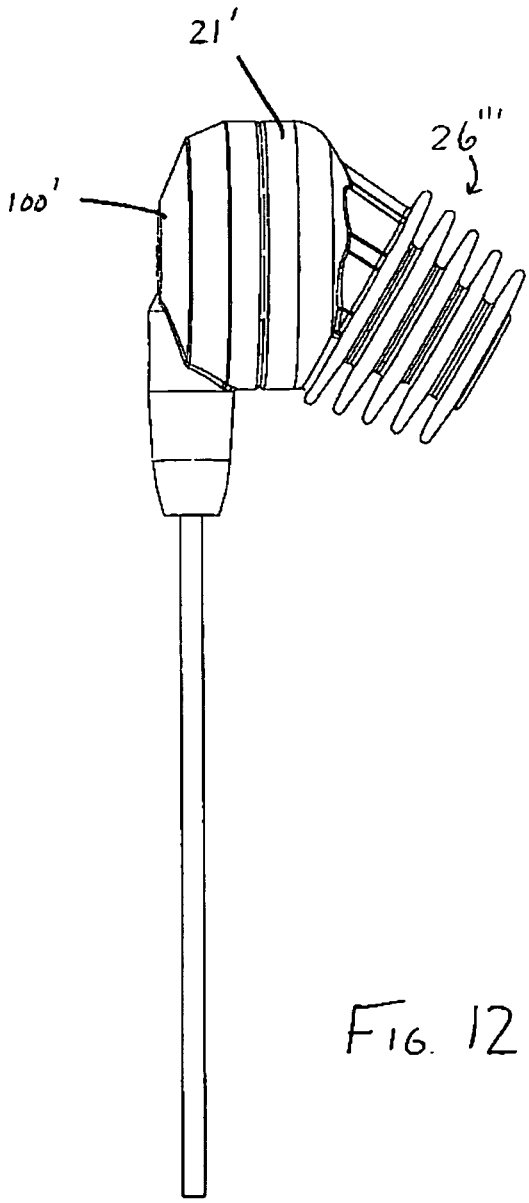
FIG. 12 is a side view of the in-ear adapter of FIG. 11 mounted to the earbud.

FIGS. 11-13 illustrate an alternative sleeve portion 21' that is formed with an undercut 70 at the second end 32' of the sleeve 21'. In the FIG. 10-13 embodiment, the undercut 70 is sized and shaped to fit within an annular groove 130 that is formed in the sidewall 111' of the earbud 100'. As noted above, the air channel 50" of this embodiment is generally frustoconical, with an outward flare at the second end 37 of the ear portion 26'".

Figure 14:
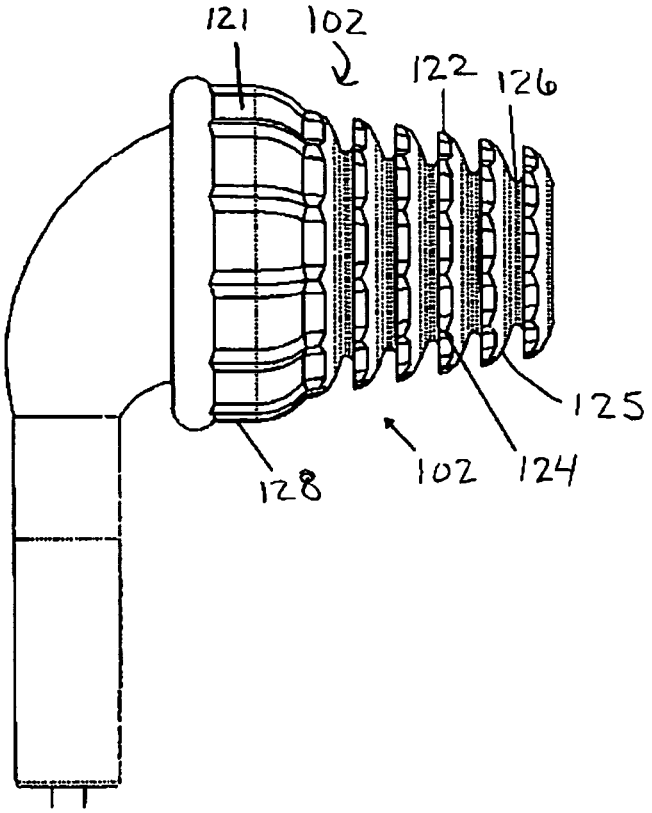
FIG. 14 is a side view of an in-ear adapter according to another embodiment of the invention shown mounted to an earbud.
Figure 15:
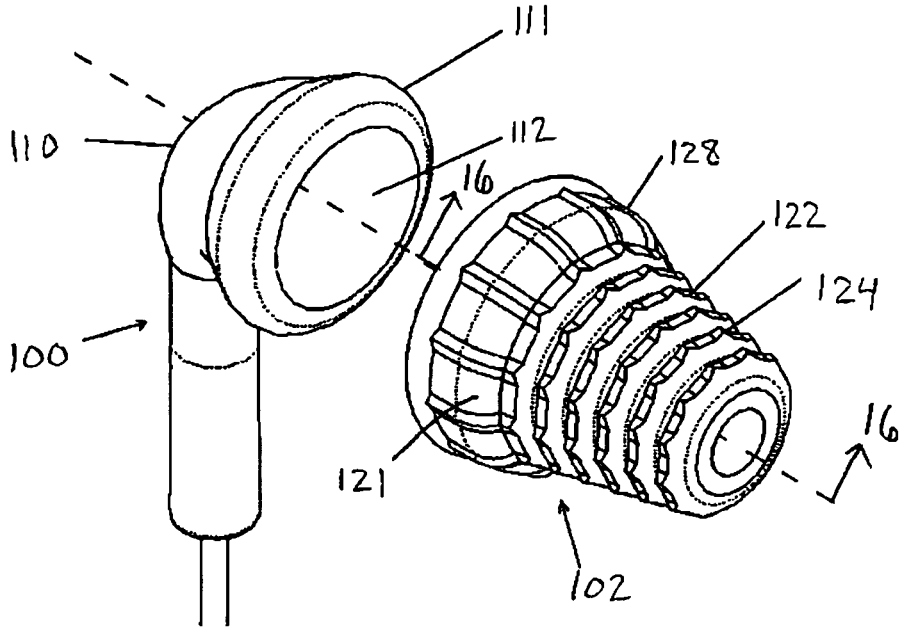
FIG. 15 is an exploded perspective view of the earbud and adapter of FIG. 14.
Figure 16:
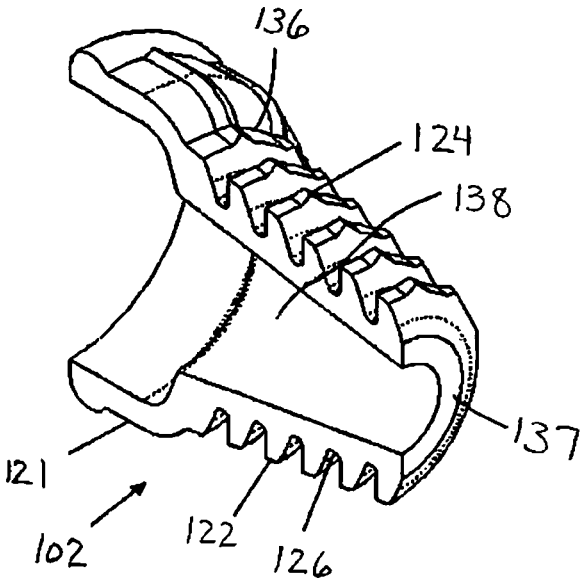
FIG. 16 is a cross sectional view of the adapter taken along line 16-16 in FIG. 15.

FIGS. 14-16 show another alternative embodiment of the adapter 102 including a plurality of fins 122, each having a plurality of protrusions 124 spaced apart around the circumference of the ear portion 126. In addition, a plurality of protrusions 128 are spaced apart about the sleeve portion 121. The protrusions may be provided to increase the surface area of the fins 122 to increase the retention of the adapter 102 in the ear. In addition, as shown in FIG. 16 and described above, the inner surface 140 of the adapter 102 is cone shaped, such that it converges from the first end 136 to the second end 137 of the ear portion 126. Further, the fins 122 of this embodiment each include a generally rounded leading edge 125 that aids in inserting the adapter 102 into the ear.

Figure 17:
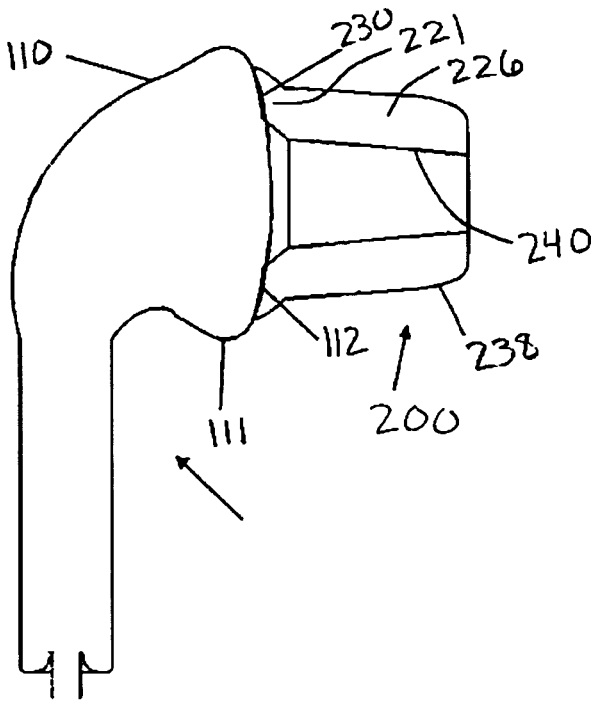
FIG. 17 is a side cross-sectional view of an in-ear adapter according to another embodiment of the present invention.

FIG. 17 shows an embodiment of the invention wherein an adapter 200 has a sleeve portion 221 that includes a face 230 that is glued to the face of the speaker 112 as an alternate means of attachment. The ear portion 226 extends away from the mounting portion as before and is thus allowed to flex both along its axis and cross section as previously described. Although not illustrated, the ear portion 226 may include fins extending from the outer surface 238, and a shaped inner surface 240, such as a twin cone shaped inner surface.

Figure 18:
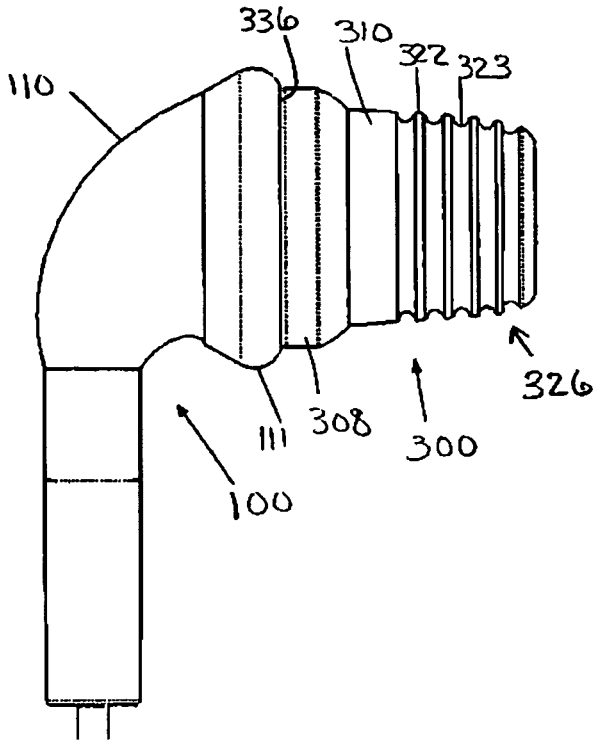
FIG. 18 is a side view of an in-ear adapter according to another embodiment of the present invention.

FIG. 18 discloses an embodiment of the adapter 300 including an ear portion 326 having a first spacer 308 extending from the first end 336 and having a generally converging cone shape, a second spacer 310 extending from the first spacer 308, and a plurality of relatively short fins 322, spaced apart by rounded valleys 323.

Figure 19:
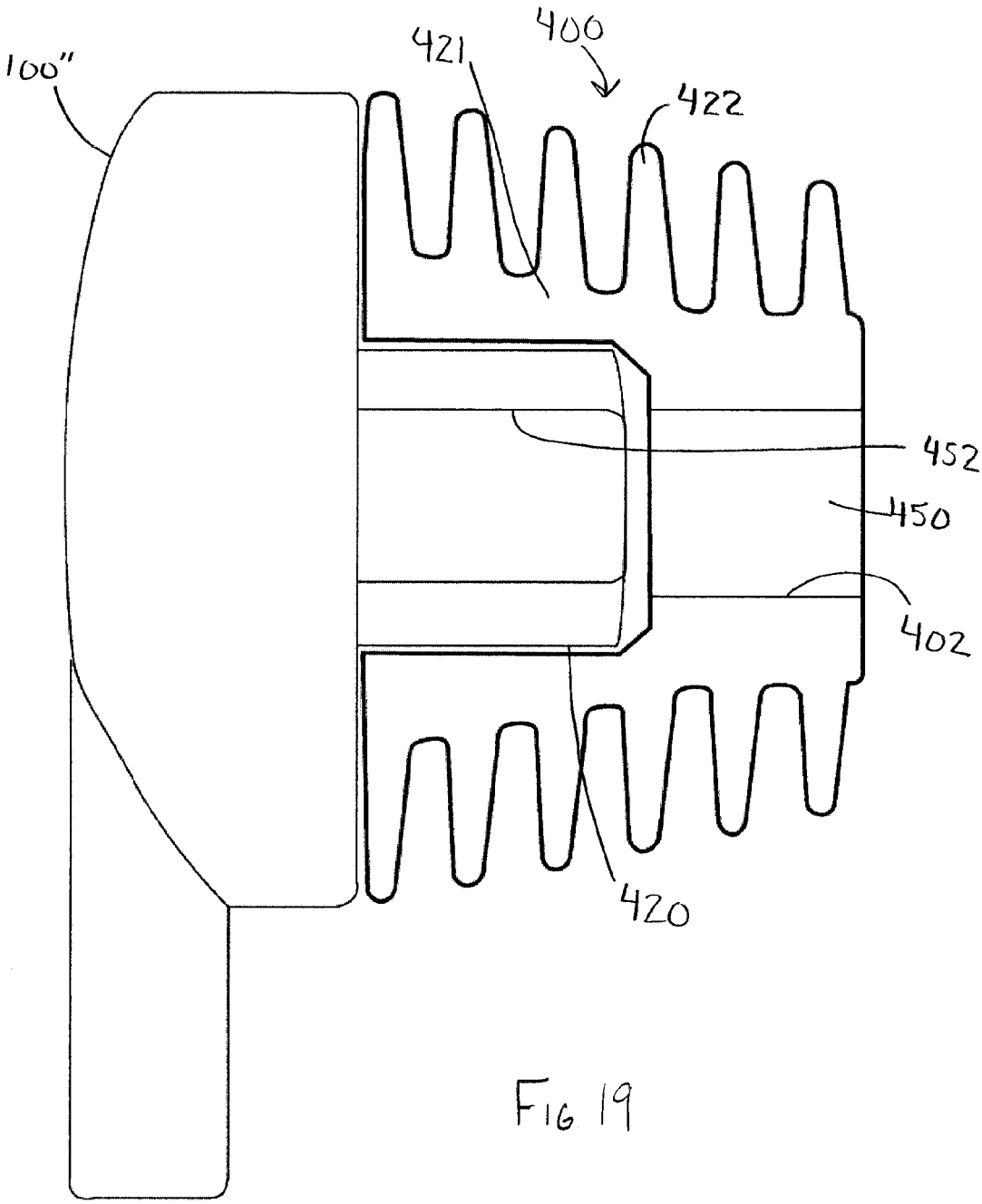
FIG. 19 is a side cross-sectional view of an in-ear adapter according to another embodiment of the present invention.
Figure 20:
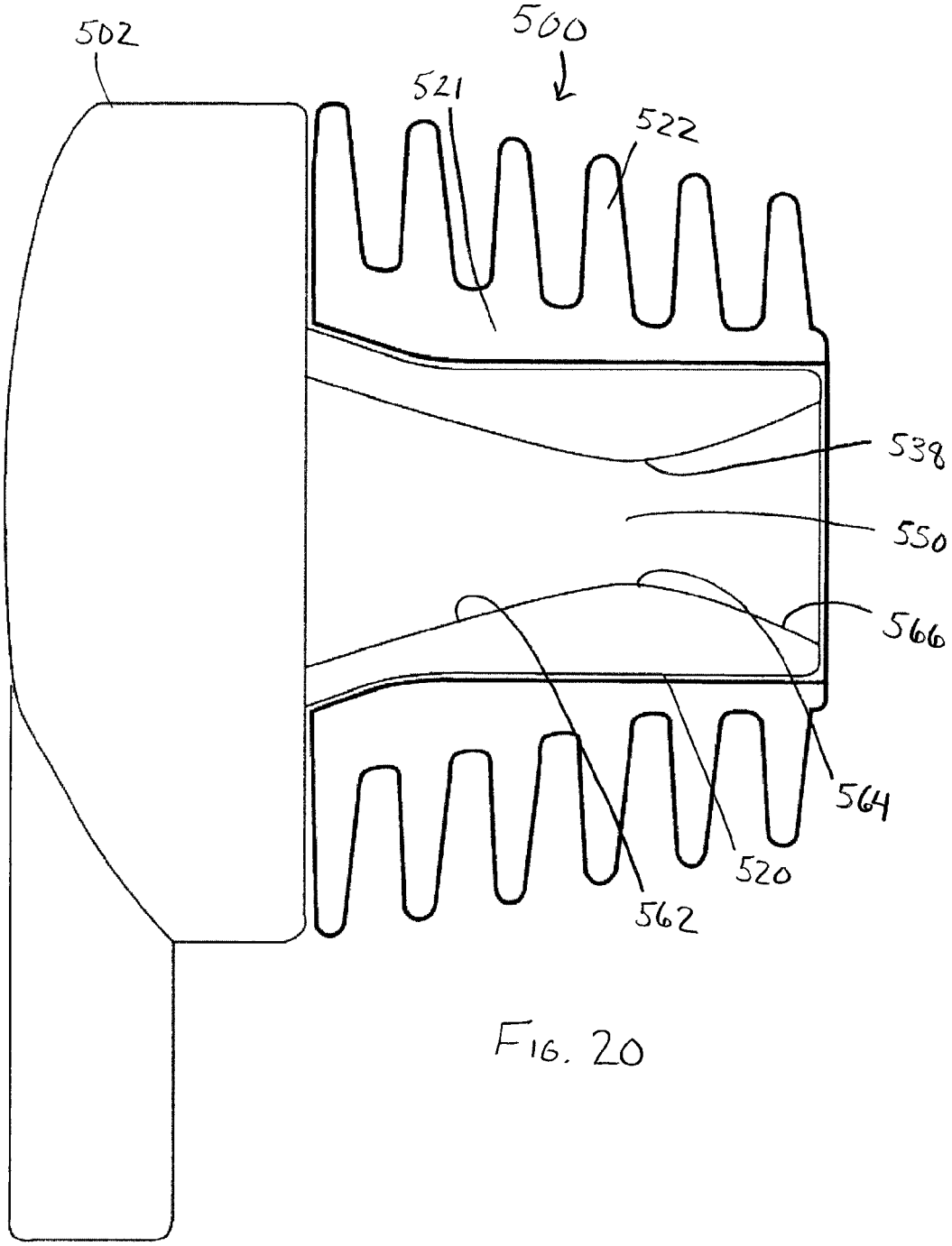
FIG. 20 is a side cross-sectional view of an in-ear adapter according to another embodiment of the present invention.
Figure 21:
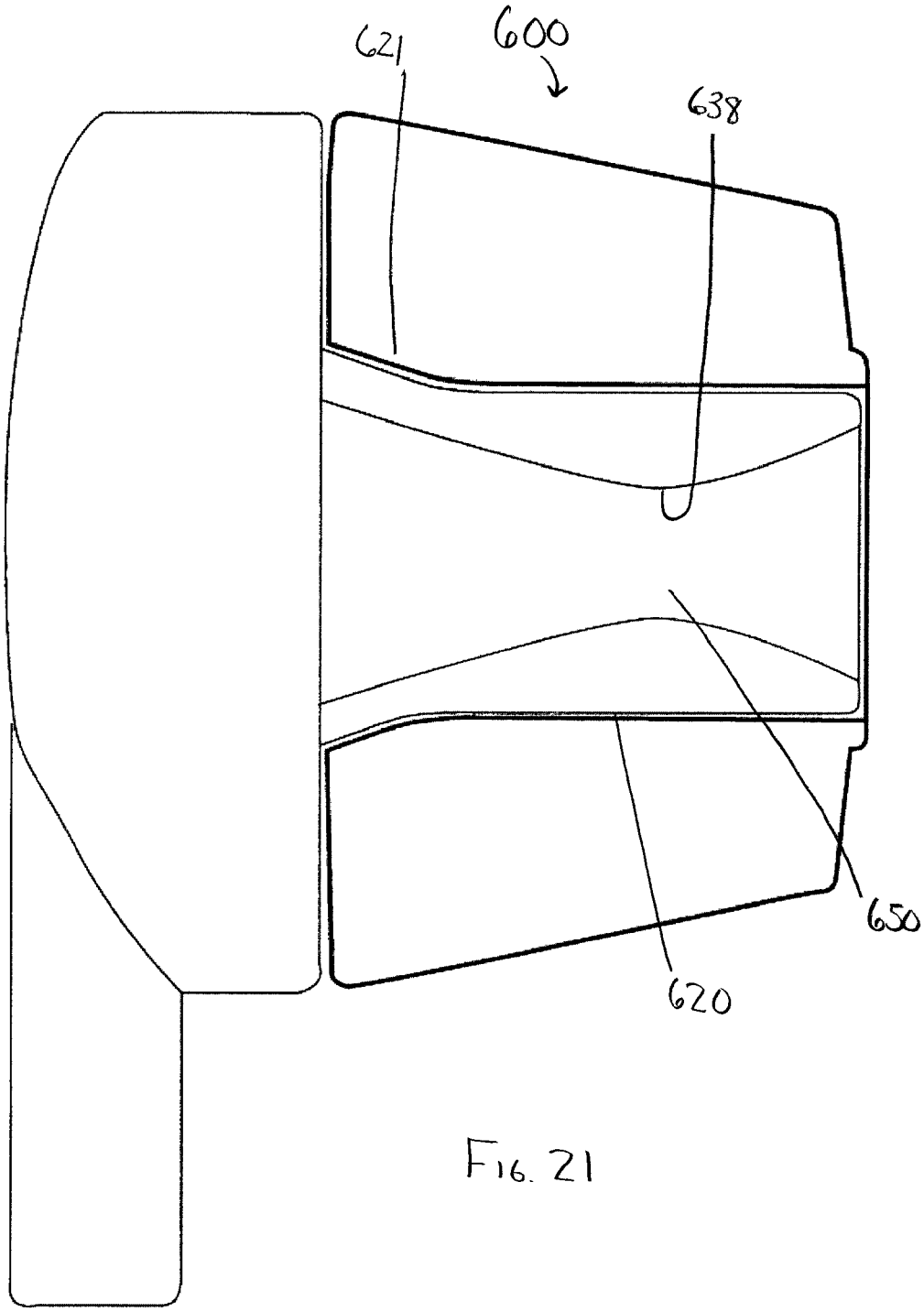
FIG. 21 is a side cross-sectional view of an in-ear adapter according to another embodiment of the present invention.

FIGS. 19-21 show alternative embodiments in which the adapter 400, 500, 600 is configured to be fitted to an earbud having a mounting post. FIG. 19 shows an adapter 400 adapted to be fitted onto an earbud 100" having a substantially straight mounting post 150. The adapter 400 generally includes a sleeve portion 421, an ear portion 426, and a plurality of fins 422 extending from both the sleeve portion 421 and the ear portion 426. The sleeve portion 421 is sized and shaped to fit snuggly over the mounting post 420. As shown, the internal diameter 452 of the mounting post 420 may coincide with the internal diameter 402 of the air channel 450. Although not shown, the air channel 450 may include a diverging cone to provide a smooth transition from the adapter 400 to the ear canal.

FIG. 20 shows an adapter 500 adapted to be fitted onto an ear phone 502 having a substantially straight mounting post 520. In this embodiment, the mounting post 520 includes an inner surface 538 that defines a twin cone air channel 550. The twin cone air channel 550 generally includes a converging cone 562, a transition portion 564 and a diverging cone 566. The adapter 500 generally includes a sleeve portion 521 and a plurality of fins 522. The sleeve portion 521 is sized and shaped to fit snuggly over the mounting post 520. As shown, the mounting post 520 may define the entire air channel, thereby eliminating the need to incorporate an air channel into the adapter 500.

FIG. 21 shows an alternative embodiment of the adapter/earbud combination of FIG. 20. In this embodiment, the adapter 600 includes a sleeve portion 621 adapted to be fitted over the ear phone mounting post 620, which includes an inner surface 638 defining a twin cone air channel 650. The adapter 600 of this embodiment does not include fins, but instead has a relatively smooth surface. Adapter 600 may be manufactured from soft resilient materials, such as TPU foam and viscoelastic polyurethane foam.

Figure 23:
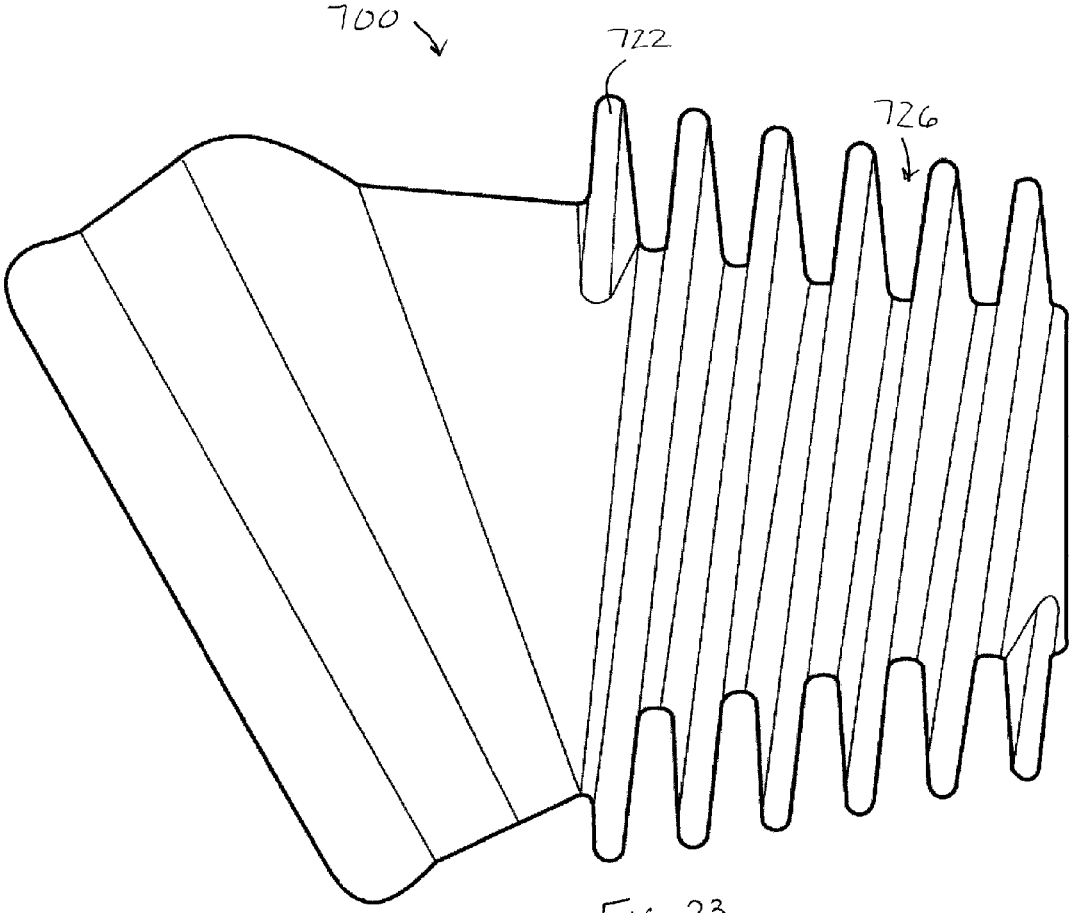
FIG. 23 is a side view of the in-ear adapter of FIG. 22.
Figure 24:
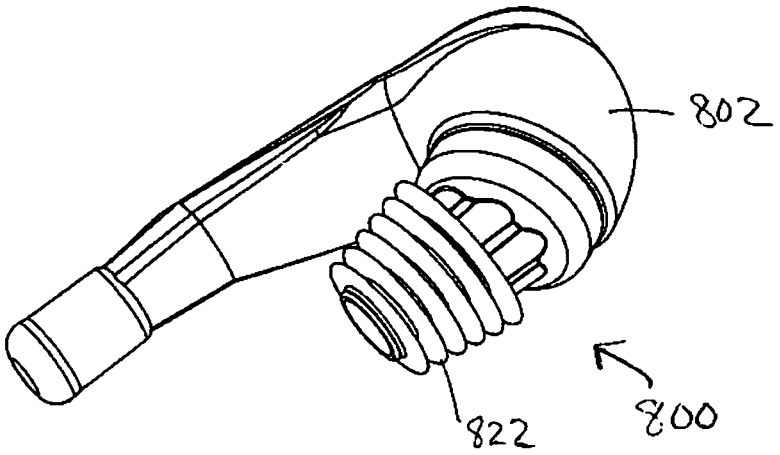
FIG. 24 is a perspective view of an in-ear adapter according to another embodiment of the present invention.
Figure 25:
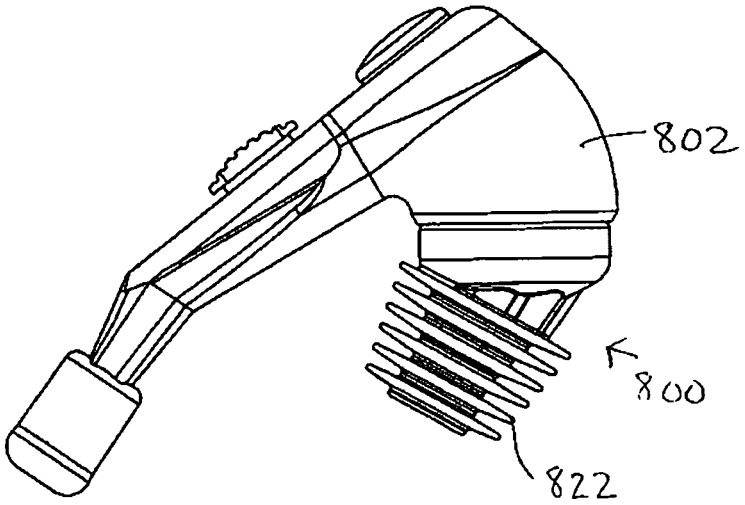
FIG. 25 is a side view of the in-ear adapter of FIG. 24.
Figure 26:
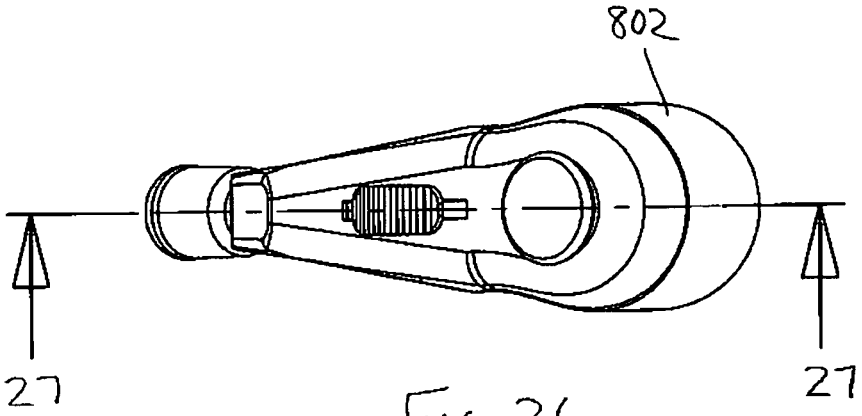
FIG. 26 is a top view of the in-ear adapter of FIG. 25.
Figure 27:
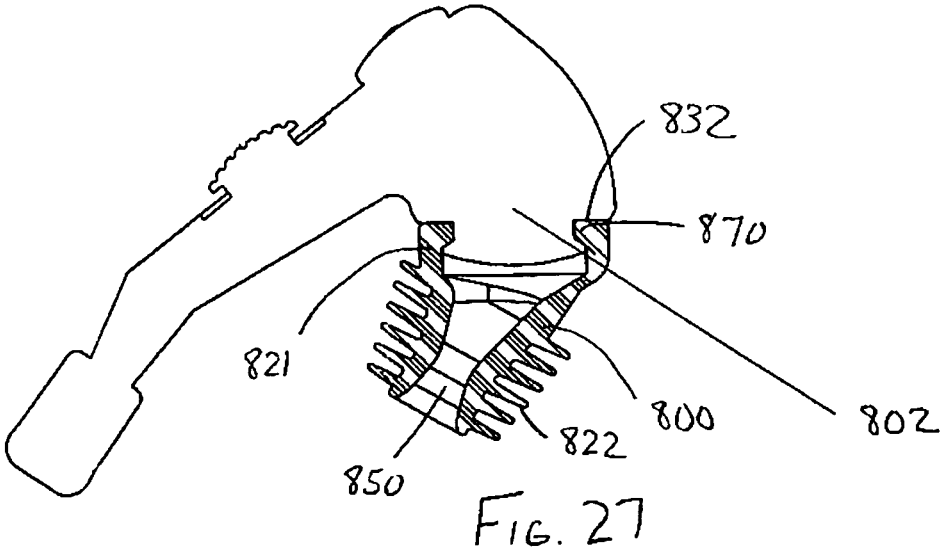
FIG. 27 is a cross-sectional view of the in-ear adapter of FIG. 25 taken along line 27-27 in FIG. 26
Figure 28:
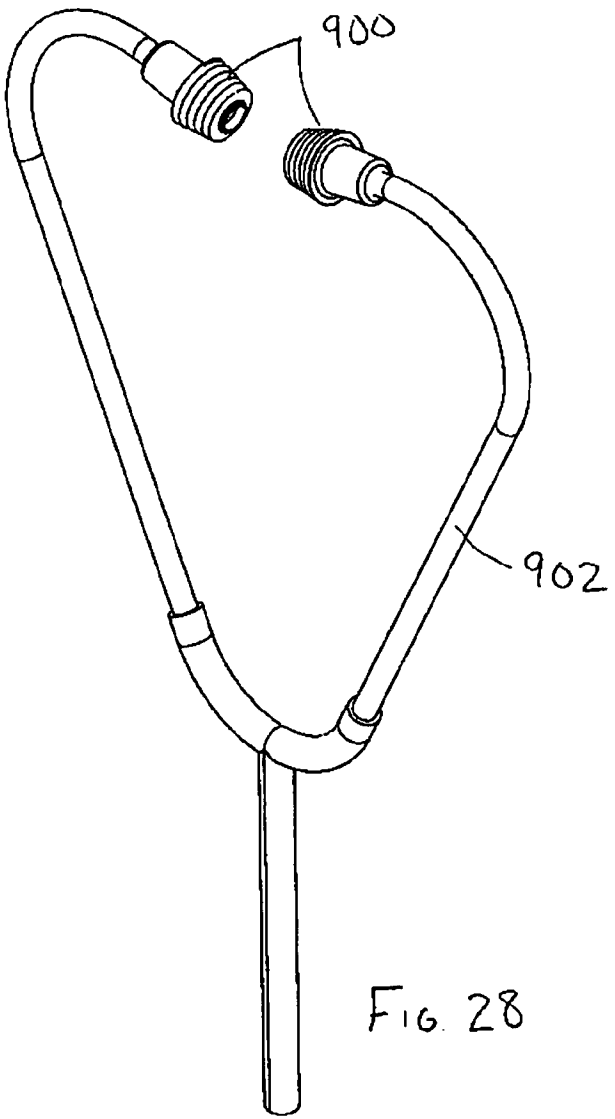
FIG. 28 is a perspective view of an in-ear adapter according to another embodiment of the present invention.
Figure 30:
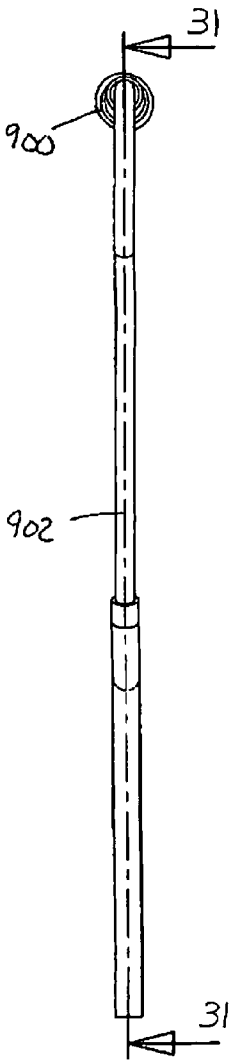
FIG. 30 is a side view of the in-ear adapter of FIG. 28.
Figure 29:
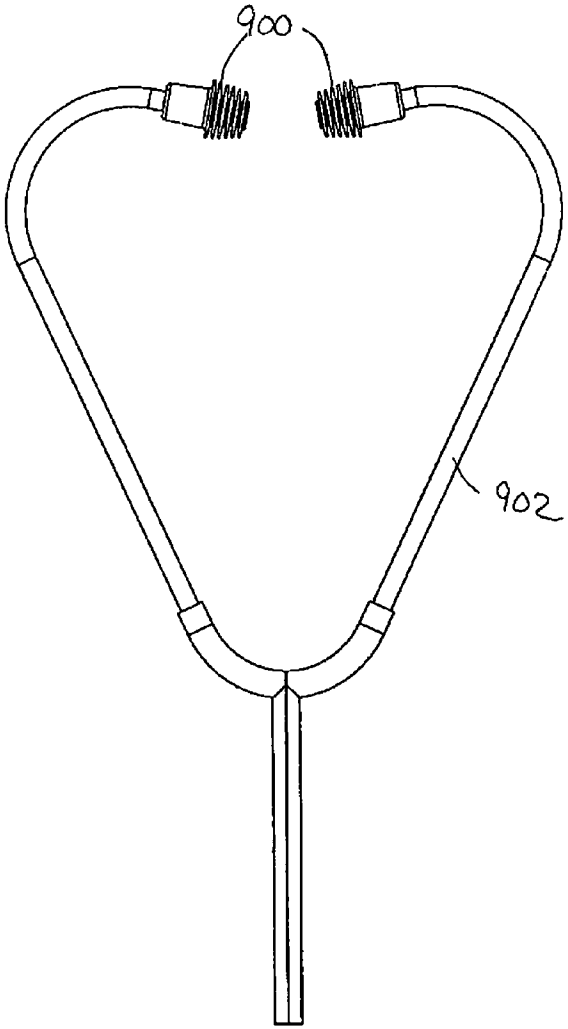
FIG. 29 is a front view of the in-ear adapter of FIG. 28.
Figure 31:
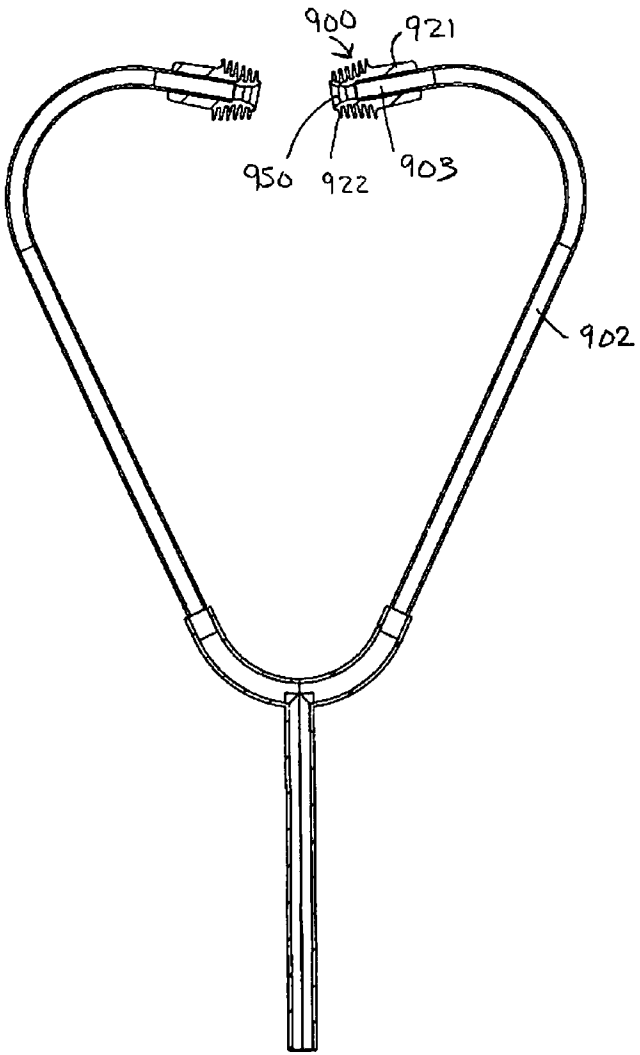
FIG. 31 is a sectional view of the in-ear adapter of FIG. 28 taken along line 31-31 in FIG. 30.

Another alternative embodiment is shown in FIGS. 22-23. FIGS. 22-23 show an adapter 700 with an alternative fin construction in which the fins are defined by a single helical rib 722 that repeatedly wraps about the ear portion 726.

FIGS. 24-27 show an embodiment of the adapter 800 attached to the earbud of a wireless or "Bluetooth" headset 802. The adapter 800 of this embodiment is substantially similar to the adapter of the first embodiment, except that the adapter 800 includes an undercut 870 at the second end 832 of the sleeve portion 821 to securely attach the adapter 800 to the Bluetooth headset 802. The adapter 802 is illustrated with six fins 822 and a twin cone air channel 850, although other variations of ribs and differently shaped air channels may be used, depending on the desired application.

FIGS. 28-31 show an embodiment of the adapter 900 attached to a stethoscope 902. The adapter 900 of this embodiment is substantially similar to the adapter of the first embodiment, except that the sleeve portion 921 is elongated and shaped to receive the generally cylindrical earbud portion 903 of the stethoscope 902 to securely attach the adapter 900 to the stethoscope 902. The earbud portion 903 of the stethoscope 902 does not include a speaker as in the previous embodiments, but, similar to the earbuds of the previous embodiments, it includes fits into a portion of the ear and includes an opening or port that emits sound. The elongated sleeve portion 921 could be a straight hole that is stretched over the cylindrical earbud portion 903. The adapter 902 is illustrated with six fins 922 and a diverging cone air channel 950, although other variations of ribs and differently shaped air channels may be used, depending on the desired application.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property of privilege is claimed are defined as follows:

1. An earbud adapter comprising:

an attachment portion adapted to attach to the earbud to retain the adapter on the earbud while allowing sound from said earbud to pass through said attachment portion;

an ear portion including a first end extending from said attachment portion and a second end opposite said first end and defining an end to the earbud adapter, said ear portion defining a length between said first and second ends, said ear portion including an outer surface shaped for insertion into an ear and an inner surface opposite said outer surface and defining an internal opening extending through said ear portion from said first end to said second end, wherein said inner surface is cone shaped from said first end of said ear portion to said second end of said ear portion, said cone shape including a converging cone and a diverging cone, said converging and diverging cones each having a surface at an angle of 5 to 25 degrees with respect to a longitudinal centerline extending through said ear portion; and a plurality of flexible fins extending outwardly from said outer surface of said ear portion, said fins spaced apart along substantially the entire said length of said ear portion between said first and second ends of said ear portion.

2. The earbud adapter of claim 1 wherein said fins each include a base, a distal tip opposite said base, a height defined between said base and said distal edge, and a thickness, at least one of said fins having a height that is twice as great as its average thickness.

3. The earbud adapter of claim 2 wherein said fins have a height of at least about 2 mm and an average thickness between said tip and said base of about 0.4 mm to 1.0 mm.

4. The earbud adapter of claim 2 wherein said fins are angled toward said first end.

5. The earbud adapter of claim 2 wherein said fins extend continuously around the circumference of said ear portion.

6. The earbud adapter of claim 1 wherein said attachment portion includes an inner surface, an outer surface, a first end attached to said ear portion and a second end opposite said first end, said inner surface at said second end having a smaller diameter than said inner surface at said first end.

7. The earbud adapter of claim 6 wherein said attachment portion includes a bulbous lip at said second end.

8. The earbud adapter of claim 1 wherein said cone shaped inner surface of said ear portion has a twin cone shape, wherein said opening includes a first portion having a diameter that decreases extending away from said first end of said ear portion, and a second portion having a diameter that increases approaching said second end of said ear portion, and wherein said outer surface of said ear portion includes at least one of said fins opposite said first portion of said inner surface with said decreasing diameter and at least one other of said fins opposite said second portion of said inner surface with said increasing diameter.

9. The earbud adapter of claim 1 wherein said attachment portion extends along a first axis and said ear portion extends along a second axis that is angled from said first axis.

10. The earbud adapter of claim 9 wherein said angle between said first axis and said second axis is about 30 degrees.

11. The earbud adapter of claim 1 wherein said attachment portion and said ear portion are formed integrally as a single, unitary piece of an elastomeric material.

12. The earbud adapter of claim 11 wherein said piece is an elastomer having a durometer of about 20 to 40 Shore A.

13. An adapter for attaching to an earbud having a speaker port, comprising:

an attachment portion adapted to attach the adapter to the earbud such that sound can pass through the speaker portion and said attachment portion; and an ear portion extending from said attachment portion, wherein said ear portion is a tubular ear portion, said ear portion including a first end proximate said speaker port, a second end opposite said first end and defining an end of the adapter, a length between said first end and said second end, and an inner surface defining an opening extending through said ear portion from said first end to said second end, wherein said inner surface has a converging cone that converges from said first end of said ear portion and a diverging cone that diverges from the converging cone to the second end of said ear portion, said converging and diverging cones each having a surface at an angle of 5 to 25 degrees with respect to a longitudinal centerline of the converging cone shape, said ear portion including an outer surface opposite said inner surface, said outer surface shaped to follow said cone shape of said inner surface, wherein said ear portion outer surface includes a plurality of fins extending outwardly from said outer surface, said fins positioned along said length of said ear portion with at least one of said fins opposite said converging cone and at least one other of said fins opposite said diverging cone.

14. The adapter of claim 13 wherein said fins each have an outer edge, said outer edge of at least one fin being oval in shape.

15. The adapter of claim 13 wherein said fins are angled with respect to said outer surface, said fins angled toward said first end.

16. The adapter of claim 13 wherein said attachment portion includes an annular sleeve portion having a first end connected to said first end of said ear portion and a second end opposite said first end, said annular sleeve portion having an inner surface defining a diameter, said diameter at said first end being larger than said diameter at said second end.

17. An elastomeric adapter for attaching to an earphone having a sidewall and a speaker face on the sidewall, the elastomeric adapter comprising:

a sleeve capable of fitting around the sidewall to retain the adapter on the earphone; and an ear portion including a tubular sidewall having a first end proximate said speaker face and a second end opposite said first end and defining an end of the elastomeric adapter, said tubular sidewall including an outer surface and a plurality of fins extending outwardly from said outer surface around the circumference of said tubular sidewall, said tubular sidewall having an inner surface defining an air channel extending through said sidewall, wherein said inner surface is cone shaped from said first end of said ear portion to said second end of said ear portion, said inner surface having a converging cone portion and a diverging cone portion, said converging cone portion extending from said first end, said diverging cone portion extending from said converging cone portion to said second end, said cone portions each having a surface at an angle of 5 to 25 degrees with respect to a longitudinal centerline extending through said converging cone portion, said fins spaced apart along substantially the entire length of said ear portion with at least one said fin positioned on said outer surface opposite said converging cone shape of said inner surface and at least one other said fin positioned on said outer surface opposite said diverging cone portion.

* * * * *